US006058607A

United States Patent [19]

Gringer

[11] Patent Number: 6,058,607

[45] Date of Patent: May 9, 2000

[54] UTILITY KNIFE WITH SNAP-OFF CARRIER AND DUAL CONTROL

[75] Inventor: Donald Gringer, New York, N.Y.

[73] Assignee: Allway Tools, Inc., Bronx, N.Y.

[21] Appl. No.: 08/881,109

[22] Filed: Jun. 23, 1997

Related U.S. Application Data

[63] Continuation-in-part of application No. 08/664,683, Jun. 17, 1996, Pat. No. 5,813,121.

[51] Int. Cl.[7] ..... B26B 1/08

[52] U.S. Cl. ..... 30/162; 30/335

[58] Field of Search ..... 30/151, 162, 335, 30/2

[56] References Cited

U.S. PATENT DOCUMENTS

| | | | |
|---|---|---|---|
| 3,577,637 | 5/1971 | Braginetz | 30/162 |
| 4,103,421 | 8/1978 | Quenot | 30/162 |
| 4,200,977 | 5/1980 | Kageyama et al. | 30/162 |
| 5,012,581 | 5/1991 | Fletcher et al. | 30/162 |
| 5,299,355 | 4/1994 | Boda et al. | 30/162 |
| 5,613,300 | 3/1997 | Schmidt | 30/162 |
| 5,806,189 | 9/1998 | Bailey | 30/162 |
| 5,813,121 | 9/1998 | Gringer | 30/162 |

FOREIGN PATENT DOCUMENTS

| | | | |
|---|---|---|---|
| 3520187 | 12/1986 | Germany | 30/162 |

*Primary Examiner*—Hwei-Siu Payer
*Attorney, Agent, or Firm*—David M. Klein; Shearman & Sterling

[57] ABSTRACT

An automatically retractable utility knife includes a housing and a blade carrier having a molded return spring, which may be integral with the blade carrier. The return spring is serpentine shaped and constructed of a resilient thermoplastic. The housing includes front and rear guide slots, with the blade carrier having a thumb piece extending through the front guide slot and a thumb piece extending through the rear guide slot for enabling the cutting device to be used by right or left-handed persons. The blade carrier may include a snap-off extension for limiting forward travel of the blade carrier with the snap-off extension in place. A method of manufacturing a utility knife includes the steps of providing a housing having an interior adapted to receive either an indexed blade carrier or an automatically retractable blade carrier, and assembling the housing with either an indexed blade carrier or an automatically retractable blade carrier therein. A locking mechanism for a utility knife includes a resilient locking arm on a first half of the housing, the locking arm having i) an upstanding portion oriented generally perpendicular to an axis of the housing, ii) an actuating arm extending laterally from a free end of the upstanding portion, so that downward force on the actuating arm causes a bending of the upstanding portion, and iii) a locking lip on the free end of the upstanding portion extending laterally in a direction opposite to the direction of bending of the upstanding portion. The second half of the housing includes a locking aperture, and a locking shoulder adjacent to the locking aperture. The locking arm and locking aperture are positioned to become aligned when the halves of the housing are aligned for assembly. The locking mechanism is released by pulling the halves apart in opposite directions generally perpendicular to the housing axis once the actuating arm has been depressed.

15 Claims, 25 Drawing Sheets

UTILITY KNIFE WITH SNAP-OFF CARRIER AND DUAL CONTROL

CROSS-REFERENCE TO RELATED APPLICATION

This is a continuation-in-part of U.S. patent application Ser. No. 08/644,683, filed Jun. 17, 1996, now U.S. Pat. No. 5,813,121.

BACKGROUND OF THE INVENTION

1. Field of the Invention

The present invention relates to an automatically retractable utility knife, and more particularly to an automatically retractable utility knife in which the blade carrier is integrally molded with the retraction spring, in which the blade carrier and housing are adapted to be used by both right-handed and left-handed persons, and in which the blade housing is adapted to receive either automatically retractable or indexed blade carriers. More generally, the invention relates to a plastic spring that may be utilized in any type of device in which the spring is only momentarily contracted or lengthened.

2. Description of the Related Art

Utility knives are well known in the art, such as those shown in U.S. Pat. Nos. 5,121,544; 5,025,558; and 4,621,425. Utility knives are typically constructed of a hollow housing having a slidable internal razor blade carrier on which a razor blade is mounted. A thumb piece is connected to the blade carrier and extends exteriorly of the housing through a slot in the housing. Using the thumb piece, the blade may be extended out of the housing through a slot at a distal end of the housing, and retracted into the housing. Most utility knives are indexed, i.e., the blade may be moved between one of several latched positions, including fully retracted and fully extended positions.

Another type of well-known utility knife is the automatically retractable type, in which the blade is normally retracted in the housing and requires continuous application of pressure by the user on the thumb piece for the blade to remain in the projected position. A spring attached between the housing and the blade carrier automatically retracts the blade upon release of the external thumb mechanism. The spring tension is such that when the blade is projected and is inserted into a material being cut, e.g., cardboard, the friction between the blade and the material is sufficient to retain the blade in the projected position. Automatically retractable utility knives are shown, for example, in U.S. Pat. Nos. 4,139,939 and 5,012,581. These types of utility knifes are expensive to manufacture due to the cost of the spring and are difficult to assemble because the spring must be secured between the blade carrier and housing. Also, the housings of conventional automatically retractable utility knives are not adapted to receive indexed blade carriers, thereby necessitating the use of separate molds for indexed knives and automatically retractable knives.

Another shortcoming of conventional utility knives is that they are typically designed to be used by right-handed persons or left-handed persons, but not by both. In those knives that are not "handed", i.e., may be used by either right-handed or left-handed persons, the blade must be reversed in order to change whether the knife is right or left handed, at great inconvenience to the user.

In most retractable utility knives, the housing is constructed of two halves which are locked together by means of a screw located toward the center of the housing. In order to replace the blade, it is necessary to unscrew the halves of the housing, which requires a screwdriver, and which is both time consuming and inconvenient. To overcome this shortcoming, utility knives with plastic housings have been developed which incorporate locking mechanisms that may be released without tools. For example, U.S. Pat. No. 5,121,544 (embodied in the Stanley™ Model 10-165 retractable utility knife) relates to a retractable utility knife that is constructed of separable plastic halves and includes a rear snap-locking mechanism. In order to operate the locking mechanism, the user must push an actuating lever and slide the halves in opposite directions generally parallel to a central axis of the housing, i.e., generally parallel to the direction of movement of the blade, before they release from each other. This locking mechanism is difficult to operate.

Prior art devices that utilize springs to return a movable member to its starting position and/or to provide shock absorption are also well know in the art and are too numerous to discuss in detail. Such devices typically utilize a metal spring that is constructed of a resilient material, usually a tempered spring steel, that is extremely hard and has enough memory to return to its original shape when subject to compression, tension, flexing, or other types of motion. Most metal springs are coiled of hard drawn music wire. Some metal springs, such as leaf or spiral springs, are constructed of flat rolled material.

Although metal springs have excellent memory, they are difficult and expensive to produce. Most coil or spiral-type springs must be coiled, cut, and squared or looped at each end, thereby requiring four operations. Higher quality springs must be made in an annealed state and post-heat-treated for extra hardness. In order to prevent rust, most metal springs must also be plated. Finally, many springs must be prelubricated with wax or grease to reduce wear. Because of the number of steps and the materials involved in manufacturing metal springs, these springs tend to be relatively expensive, and generally may not be constructed integrally with the part that the spring is moving.

Hughes, U.S. Pat. No. 5,164,871 relates to a magnetic disk cassette which includes a case formed of a molded plastic material defining an interior space in which the disk is located. A shutter formed of a plastic material is reciprocally movable on the case between an open position, in which the disk may be accessed through a window in the case, and a closed position in which the shutter covers the window. An elongate spring is integrally molded with either the case or the shutter so as to exert a bias force on the shutter toward the closed position.

One shortcoming of the Hughes device is that the plastic spring tends to set when left in a compressed position. Accordingly, if the Hughes disk is left in a disk drive with the shutter open for an extended period of time, the spring becomes set in the compressed position. As a result, when the disk is removed from the disk drive, the shutter will not entirely close.

Accordingly, it would be desirable to have a plastic spring that may be used to replace metal springs in momentary applications, and that may be integrally molded with the member that the spring is used to bias.

Accordingly, it would be desirable to have a utility knife housing which is adapted to receive automatically retractable or indexed blade carriers so that the utility knife housing may be used for either application.

It would also be desirable to have an automatically retractable utility knife in which the blade carrier is integral with the retraction spring so as to reduce the cost and complexity of manufacture.

It would be further desirable to have a utility knife that does not require the removal of the blade in order to be used by right or left handed persons.

Finally, it would be desirable to have a utility knife with a hand-operated release mechanism that is inexpensive to manufacture and simple to use.

SUMMARY OF THE INVENTION

The present invention is an automatically retractable utility knife which includes a housing and a blade carrier disposed within the housing, the blade carrier having an integrally molded return spring. The return spring is preferably serpentine shaped and constructed of an acetal resin or other resilient thermoplastic. The housing includes a guide slot and the blade carrier comprises a thumb piece extending through the slot for facilitating movement of the blade carrier in the housing to extend and retract a razor blade. Alternatively, the housing may include front and rear guide slots, with the blade carrier having a thumb piece extending through the front guide slot and a thumb piece extending through the rear guide slot for enabling the cutting device to be used by right or left-handed persons. The blade carrier may also include a snap-off extension for limiting forward travel of the blade carrier with the snap-off extension in place. A spring securing pin is fixed to the housing for securing a free end of the return spring.

A method of manufacturing a utility knife includes the steps of providing a housing having an interior adapted to receive either an indexed blade carrier or an automatically retractable blade carrier, and assembling the housing with either an indexed blade carrier or an automatically retractable blade carrier therein. The housing is constructed of separable halves, and the step of assembling the housing involves the steps of installing the blade carrier in one of the housing halves, and connecting the separable halves to form the housing. The housing includes a plurality of locking apertures, and the indexed blade carrier comprises a locking protuberance that engages with the locking apertures to enable the indexed blade carrier to be moved to a plurality of positions within the housing.

For assembly of the housing with an automatically retractable blade carrier, the housing includes a spring securing pin. A retraction spring is inserted between the automatically retractable blade carrier and the spring pin during assembly. The retraction spring and the automatically retractable blade carrier may be integrally molded.

Also provided is a locking mechanism for a utility knife having a housing constructed of first and second separable halves. The housing has an axis that extends between the front and rear ends thereof. The locking mechanism includes a resilient locking arm on the first half of the housing, the locking arm comprising i) an upstanding portion oriented generally perpendicular to the housing axis, the locking arm having a first end attached to the first half of the housing and a second end, ii) an actuating arm extending laterally from the second end of the upstanding portion, whereby downward force on the actuating arm results in a bending of the upstanding portion, and iii) a locking lip on the second end of the upstanding portion extending laterally in a direction opposite to the direction of bending of the upstanding portion during downward force on the actuating arm. The second half of the housing comprises a locking aperture sized to receive the second end of the locking arm, and a locking shoulder adjacent to the locking aperture. The locking arm and locking aperture are correspondingly positioned so as to become aligned when the halves of the housing are aligned for assembly. During assembly, the locking arm extends into the locking aperture and the locking lip positively locks on the locking shoulder. Thus, the locking mechanism is actuated by pressing the halves together in opposite directions generally perpendicular to the axis of the housing, and released by application of downward force on the actuating arm and by pulling the housing halves in opposite directions generally perpendicular to the axis of the housing.

More generally, the present invention provides an improvement to any apparatus having first and second portions and a spring extending between the first and second portions for exerting a spring force thereon, and in which the spring is only momentarily compressed or extended. The improvement consists of the spring being constructed of a molded or extruded thermoplastic, and preferably an acetal resin. The spring is preferably accordion, serpentine, or coil shaped and is preferably integral with the first and/or second portions. The spring may be tapered in height or thickness, or molded shaped to provide clearance for another element.

DETAILED DESCRIPTION OF THE INVENTION

Figure 1:
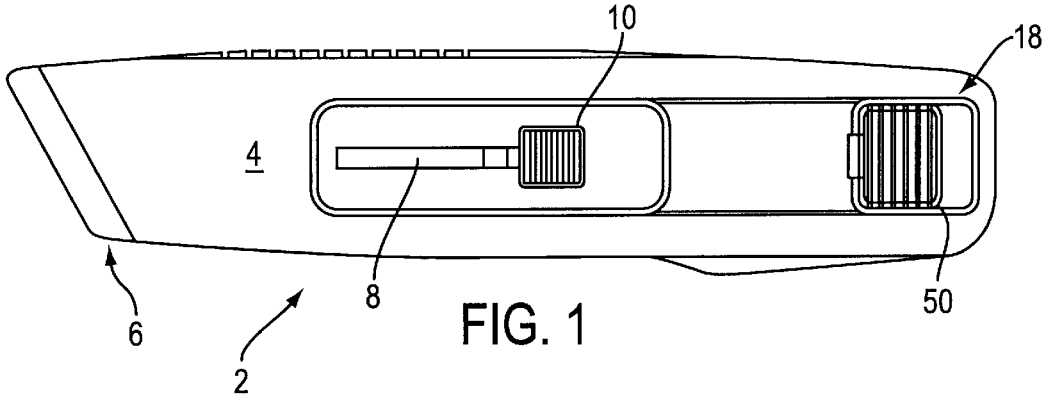
FIG. 1 is a top view of an indexed retractable utility knife in accordance with the invention.
Figure 2:
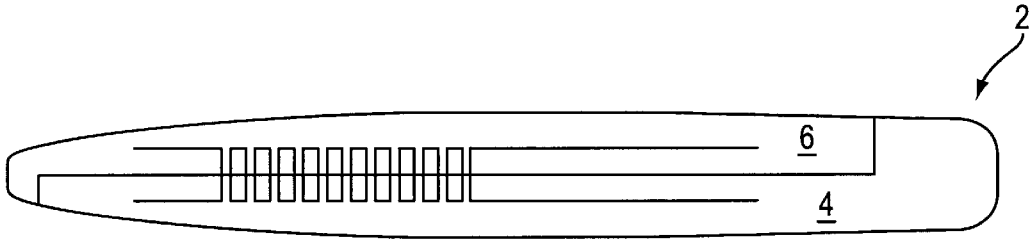
FIG. 2 is a side view of the utility knife shown in FIG. 1.
Figure 3:
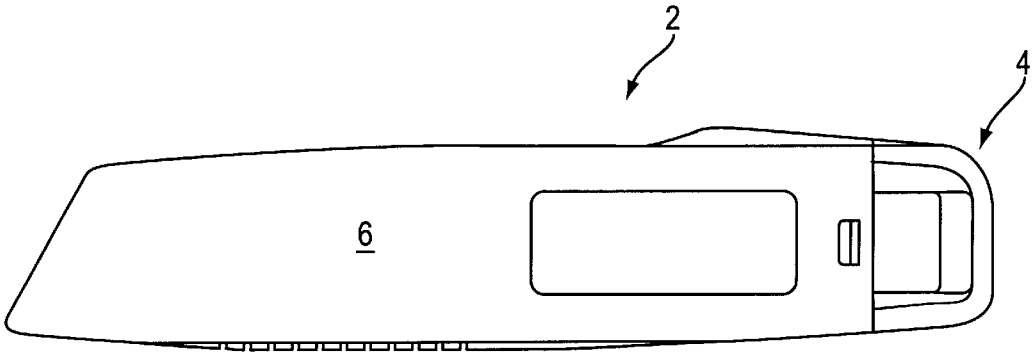
FIG. 3 is a bottom view of the utility knife shown in FIG. 1.
Figure 4:
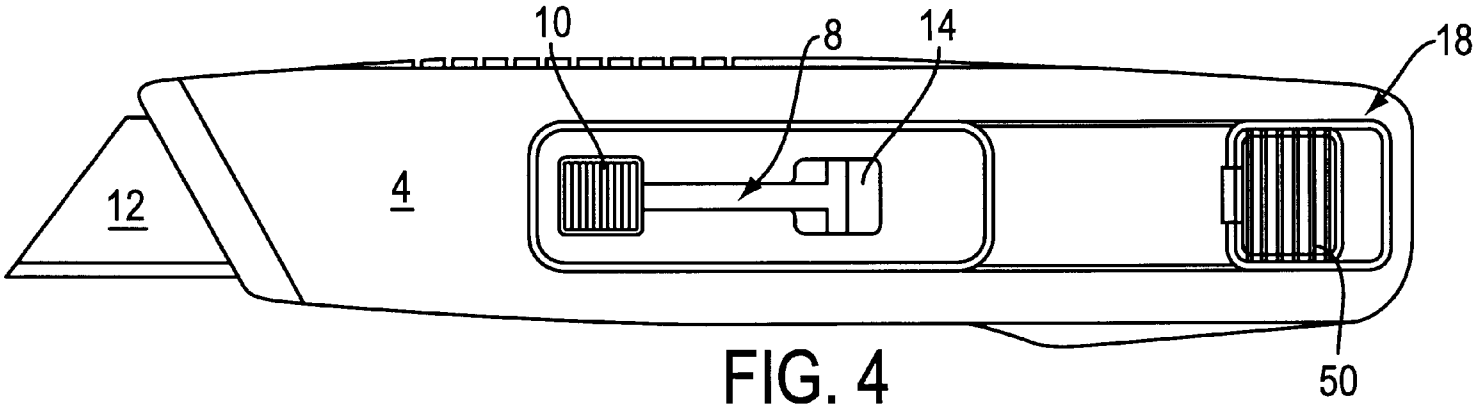
FIG. 4 is a top view of an indexed retractable utility knife with the blade in the extended position.
Figure 5:
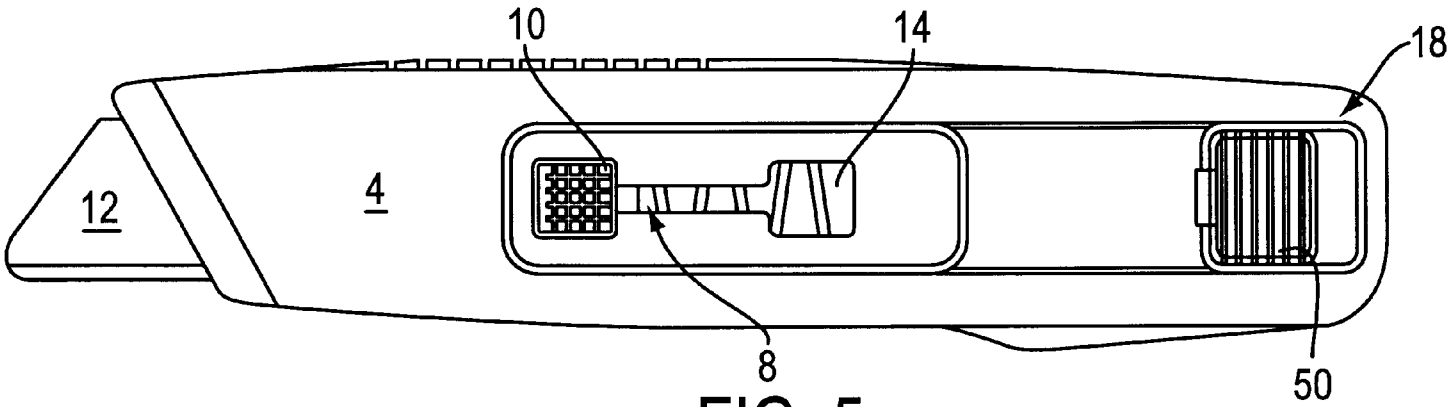
FIG. 5 is a top view of an automatically-retractable utility knife with the blade in the extended position.
Figure 6:
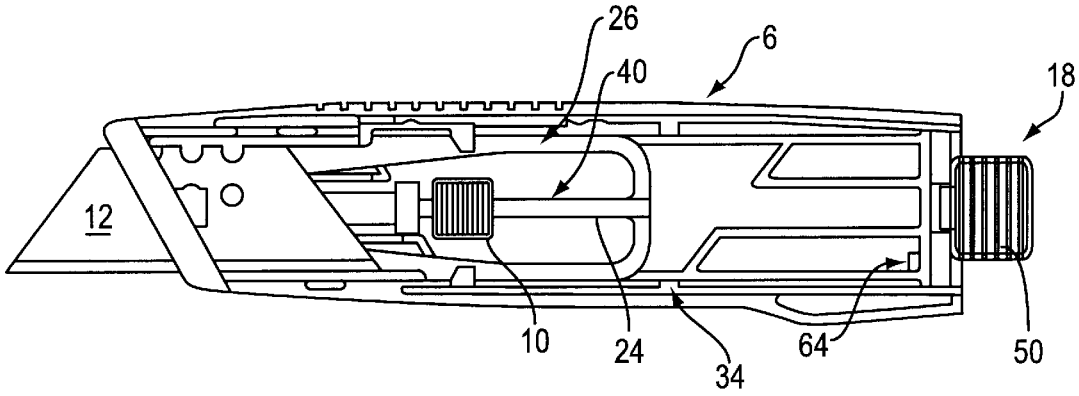
FIG. 6 is a top view of an indexed utility knife with the blade in the exposed position and with the upper housing removed.
Figure 7:
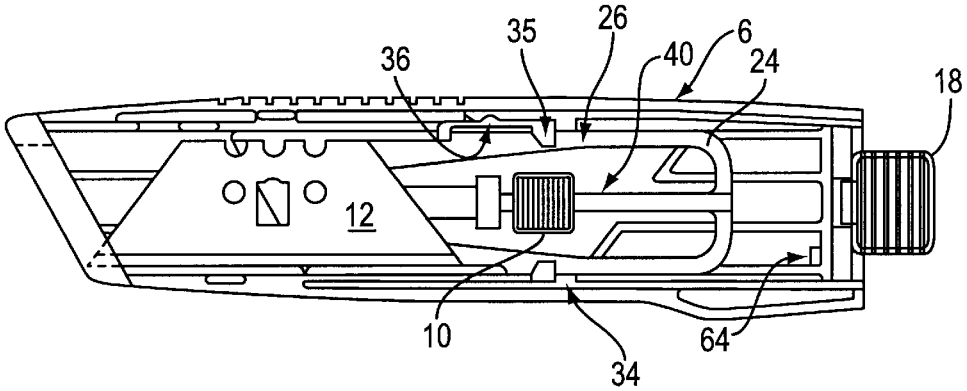
FIG. 7 is a top view of an indexed utility knife with the blade in the retracted position and with the upper housing removed.

As shown in FIGS. 1–6, the present invention is a utility knife having a housing 2 that is constructed of an upper housing 4 and a lower housing 6. Upper housing 6 includes a slot 8 extending therethrough. A thumb piece 10 is preferably integral with the blade carrier (discussed below) and extends through slot 8 so that movement of the thumb piece along the slot by the user causes projection and retraction of cutting blade 12, which may be either of the type having rounded edges (FIG. 8) or sharp edges (FIG. 7). One end of slot 8 forms an enlarged opening 14 with dimensions larger than thumb piece 10 to enable thumb piece 10 to be inserted therethrough during assembly.

Housing 4 is adapted to accept either an automatically retractable blade carrier 22, such as that shown in FIGS. 8–10 and 43–49; or an indexed-typed blade carrier 24, such as that shown in FIGS. 6–7 and 36–42. Each type of blade carrier 22 or 24 rides on and is supported by carrier guides 20 and includes blade retention projections 56 and guides 58 for supporting the razor blade. Lower housing 6 also includes support platforms 28 which support the blade carrier 22 or 24 through its range of movement in housing 2. Support platforms 28 taper toward the distal end 30 of housing 2 in order to align razor blade 12 with slot 32 on the distal end of the housing. Lower housing 6 also includes detents 34 that contact carrier end stops 35 to prevent rearward movement of the blade carrier beyond the detents (see FIGS. 7 and 10). Carrier end stops 35 ride on and are supported by support shoulders 37.

Figure 25:
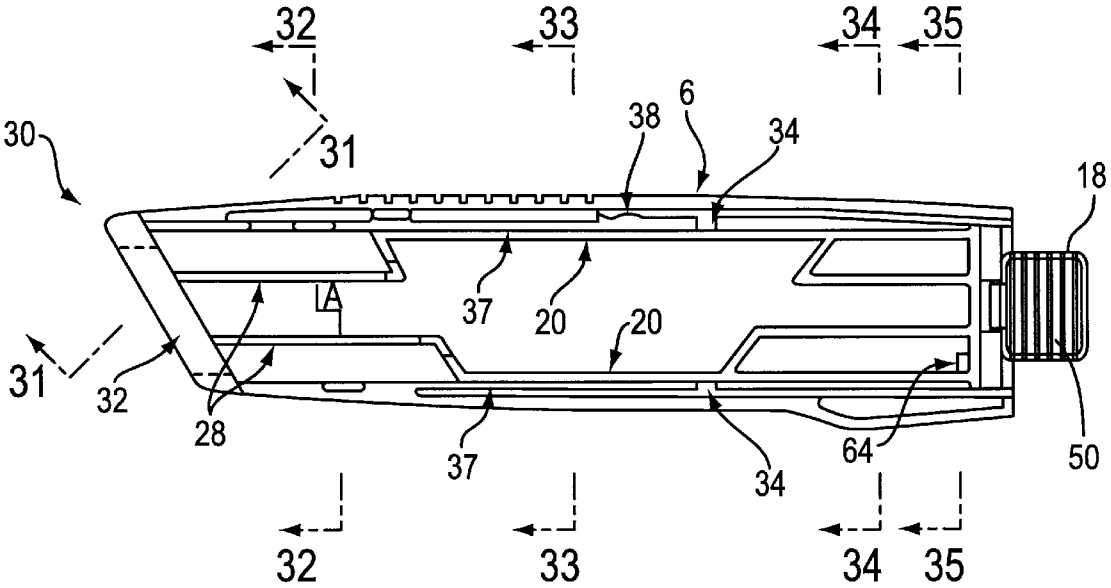
FIG. 25 is a view of the interior side of the lower housing.
Figure 36:
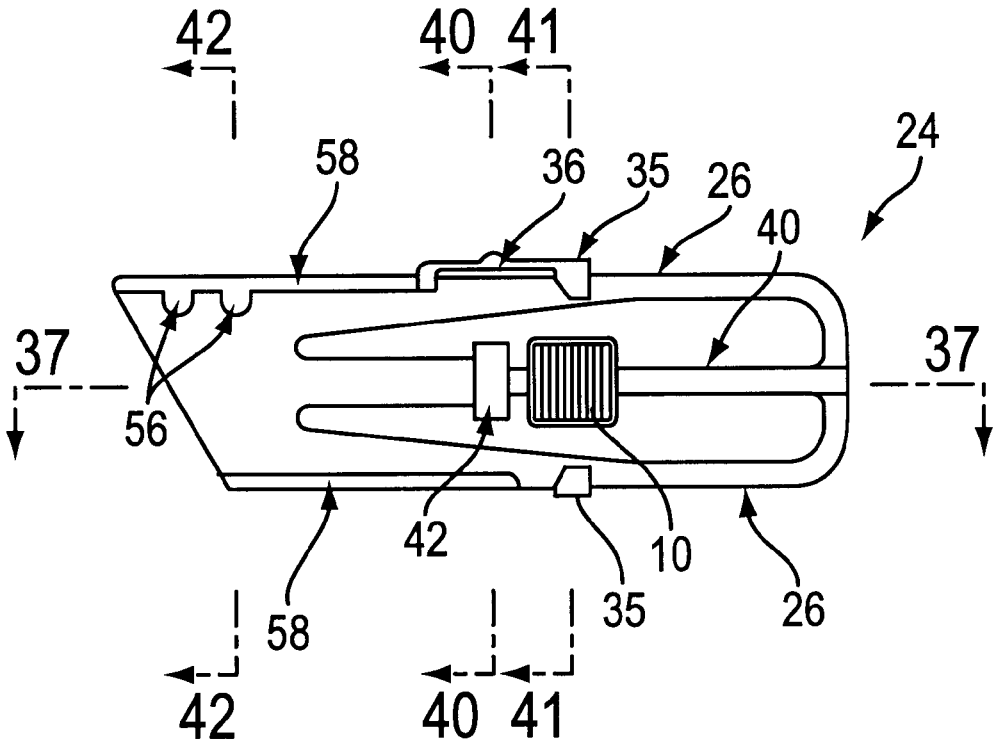
FIG. 36 is a top view of an indexed blade carrier.

As shown in FIGS. 7, 25, and 36, indexed blade carrier 24 includes a resiliently biased rear position lock 36 that snaps into a correspondingly shaped rear position cutaway 38 on lower housing 6 to secure the blade carrier in the lower housing when the blade carrier is in the rearmost position and the upper housing is removed. Rear position lock 36 frictionally engages with rear position cutaway 38 so that carrier 24 is held in place when the housing is opened, although carrier 24 may be removed with minimal effort for obtaining access to the blade storage area therebelow.

Figure 23:
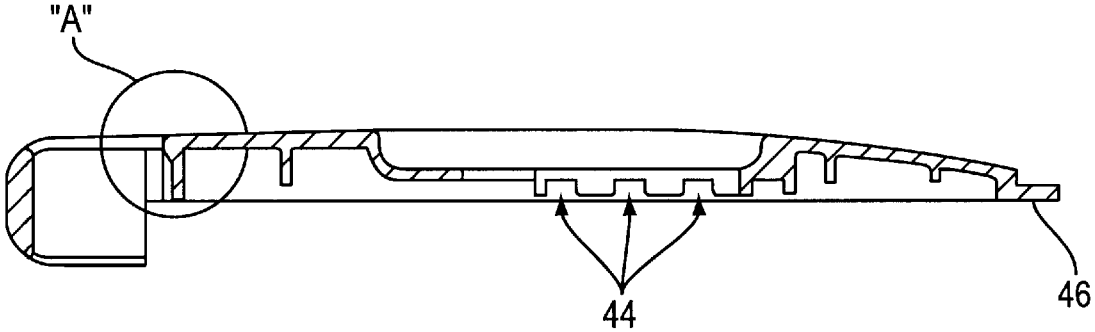
Figure 30:
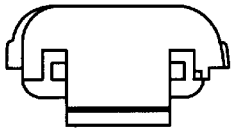
FIG. 30 is an opposite end view of the lower housing shown in FIG. 25.
Figure 37:
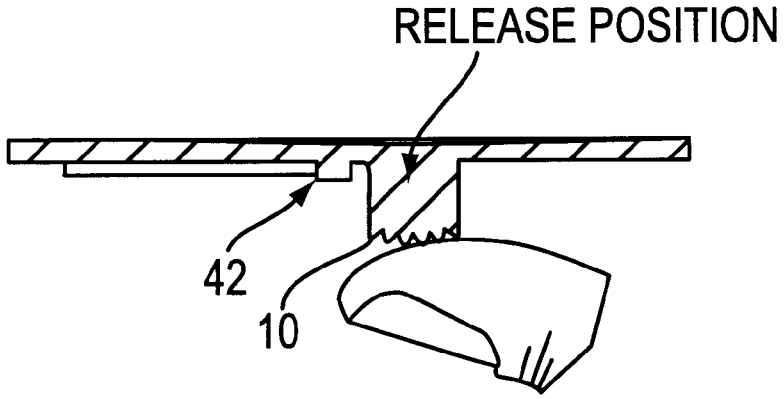
FIGS. 37 and 38 are partial cross-sectional views through Section 37—37 of FIG. 36 showing the blade carrier in a released position (FIG. 37) and in a locked position (FIG. 38).
Figure 38:
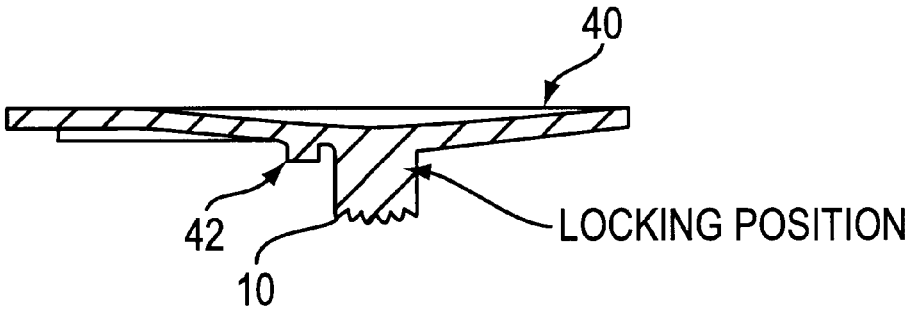
Figure 39:
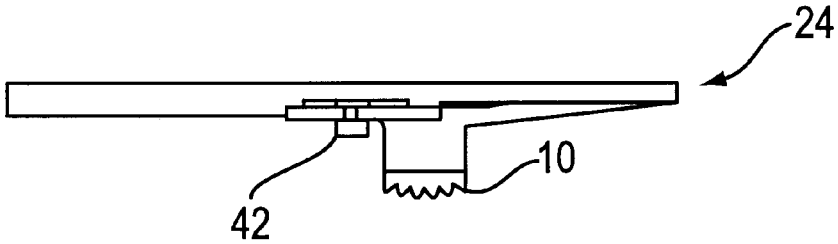
FIG. 39 is a side view of the blade carrier shown in FIG. 36.
Figure 40:
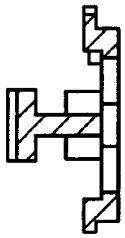
FIGS. 40–42 are cross-sectional views through the corresponding Sections shown in FIG. 36.
Figure 41:
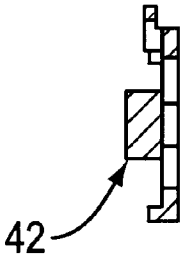
Figure 42:
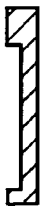
Figure 43:
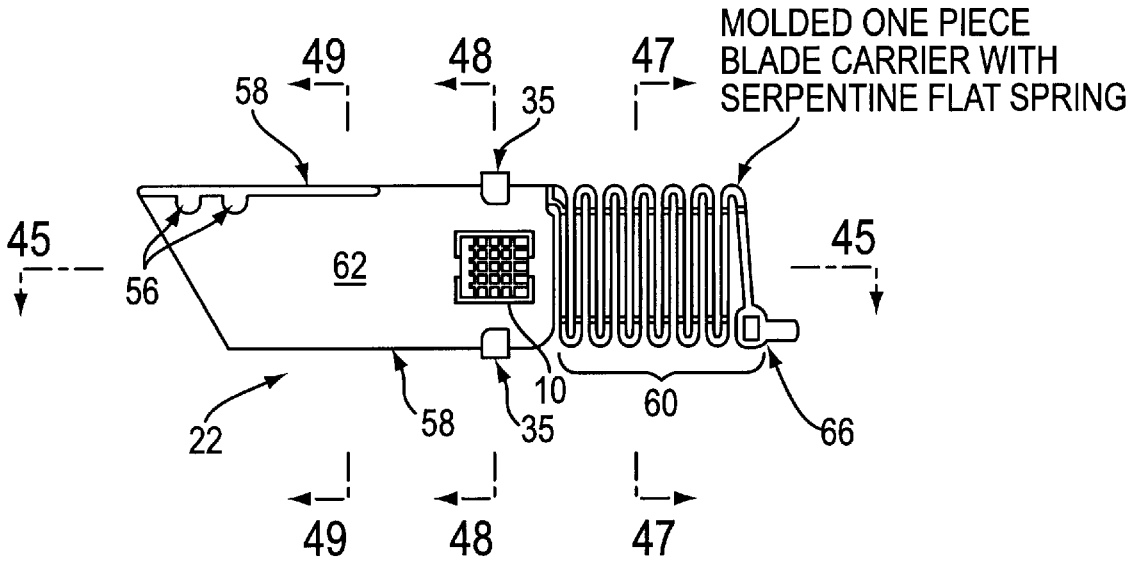
FIG. 43 is a top view of an automatically-retractable blade carrier.
Figure 44:
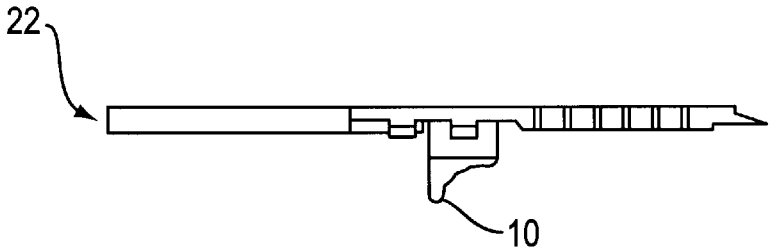
FIG. 44 is a side view of the blade carrier shown in FIG. 43.
Figure 45:
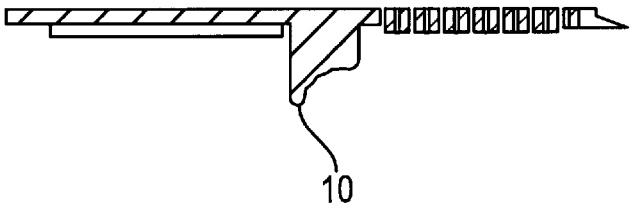
FIG. 45 is a cross-sectional view through Section 45—45 of FIG. 43.
Figure 46:
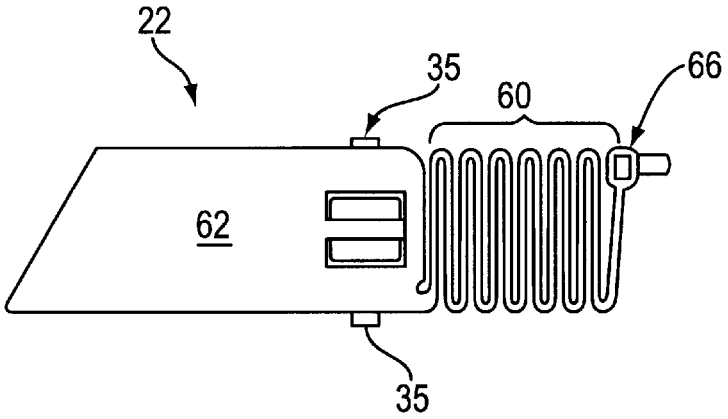
FIG. 46 is a bottom view of the blade carrier shown in FIG. 43.
Figure 47:
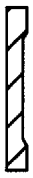
FIGS. 47–49 are cross-sectional views through the corresponding Sections shown in FIG. 43.
Figure 48:
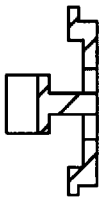
Figure 49:
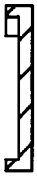

As shown in FIGS. 36–42, indexed carrier 24 includes a thumb piece 10 that is mounted to, and preferably integrally molded with, a central arm 40 on the blade carrier. As shown in FIG. 23, upper housing 4 includes a number of locking apertures 44 that enable the indexed blade carrier to be locked in several different positions including a fully extended position (FIG. 6), a fully retracted position (FIG. 7), and at least one intermediate position. A carrier lock 42 on central arm 40 engages with locking apertures 44. The dimensions of carrier lock 42 are just slightly smaller than locking apertures 44 so that the lock will firmly enter and lock into each aperture with little lateral movement. Central arm 40 is bent slightly and acts as a leaf spring so as to engage carrier lock 42 into locking apertures 44 with a snapping action, thereby achieving a positive locking effect. As shown in FIG. 37, thumb pressure on thumb piece 10 causes central arm 40 to temporarily bend away from the upper housing to release carrier lock 42 from locking apertures 44 and to enable the indexed carrier to be moved between its various positions. Once pressure is released from thumb piece 10, central arm 40 is biased toward the upper housing so that carrier lock 42 will engage with the next locking aperture 44 with which it becomes aligned.

Figure 29:
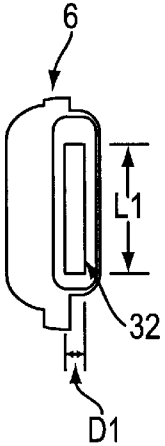
FIG. 29 is an end view of the lower housing shown in FIG. 25.

As shown in FIGS. 11–14, upper housing 4 includes a lip 46 on the front end thereof. Lip 46 is preferably integrally molded with the upper housing. Lower housing 6 includes a slot 32 on the front end thereof that is sized to enable lip 46 to be inserted therein with the upper and lower housings aligned. The length "L" of lip 46 (FIG. 14) is preferably closely sized to the interior length "L1" of slot 32 (FIG. 29) so that with the lip inserted in the slot, there is little or no lateral movement between the two halves of the housing. It will be appreciated that with lip 46 inserted in slot 32, it will still be necessary for a blade to extend through the slot. Accordingly, the thickness "D" of lip 46 (FIG. 13) and the thickness "D1" of slot 32 (FIG. 29) are sized so that there is sufficient clearance for a razor blade to extend through slot 32 with lip 46 therein.

Figure 26:
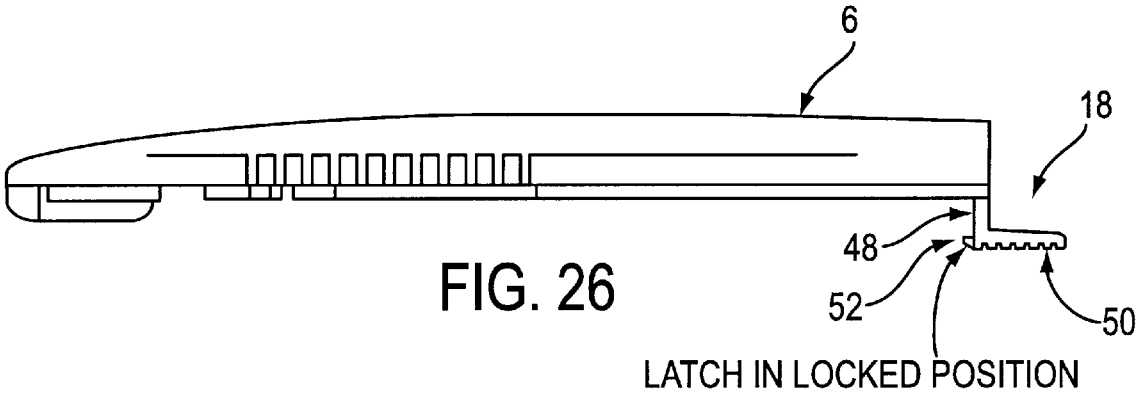
FIG. 26 is a side view of the lower housing shown in FIG. 25.
Figure 27:
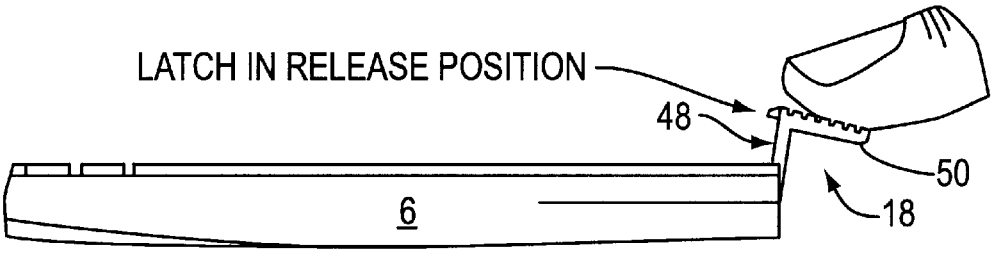
FIG. 27 is a partial opposite side view of the lower housing shown in FIG. 25.
Figure 28:
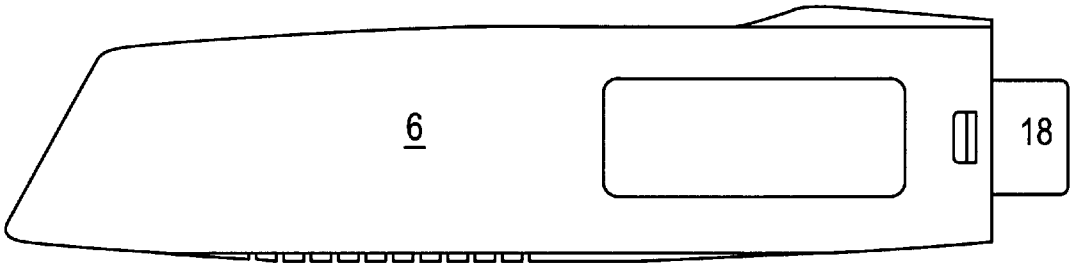
FIG. 28 is a view of the exterior side of the lower housing.
Figure 31:
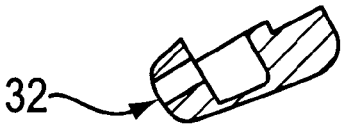
FIGS. 31–35 are cross-sectional views of the lower housing shown in FIG. 25 through the Sections corresponding to each FIG. No.
Figure 32:
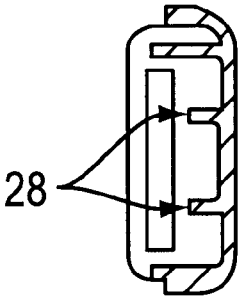
Figure 33:
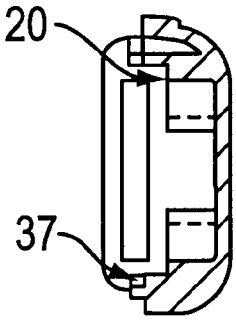
Figure 34:
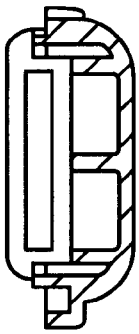
Figure 35:
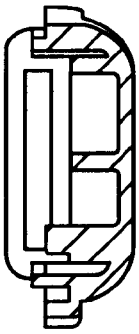

Locking of the upper housing 4 to the lower housing 6 is provided by means of a release lever 18, which is preferably integral with lower housing 6, and a release aperture 16 into which the release lever is inserted. Release lever 18 includes an upwardly-extending portion 48 that is integral with a thumb lever 50. When the release lever 18 is inserted into release aperture 16 and the upper and lower housings are pressed together in a direction generally perpendicular to the axis of the housing, i.e., generally perpendicular to the direction of blade movement within the housing, release latch 52 (FIG. 25) resiliently engages with locking lip 54 (FIG. 14) to lock the upper and lower housings together. When no downward pressure is applied to release lever 18, it returns to its resting position, as shown in FIG. 26. In order to separate the upper and lower housings so as to change a blade or the blade carrier, downward pressure is applied to thumb lever 50 thereby causing upwardly extending portion 48 to bend slightly to enable release latch 52 to clear locking lip 54 (FIG. 27). The housing may then be opened by pulling the upper and lower housings apart in a direction generally perpendicular to the axis of the housing. Once the locking mechanism has released and the rear ends of the upper and lower housings have separated, a very slight rearward movement is necessary to remove lip 46 from distal end slot 32. Thus, with the locking mechanism of the invention, the housing may be opened without the difficult movement of the upper and lower housings required in prior art locking mechanisms, such as that shown in U.S. Pat. No. 5,121,544.

Figure 8:
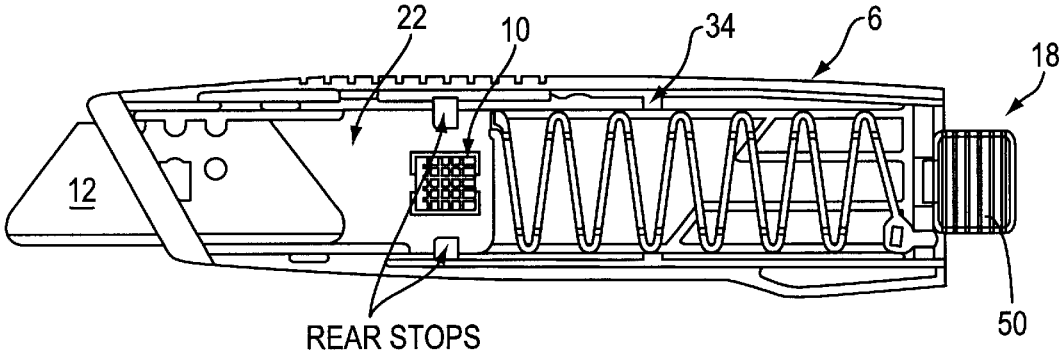
FIG. 8 is a top view of an automatically-retractable utility knife with the blade in the extended position and with the upper housing removed.
Figure 9:
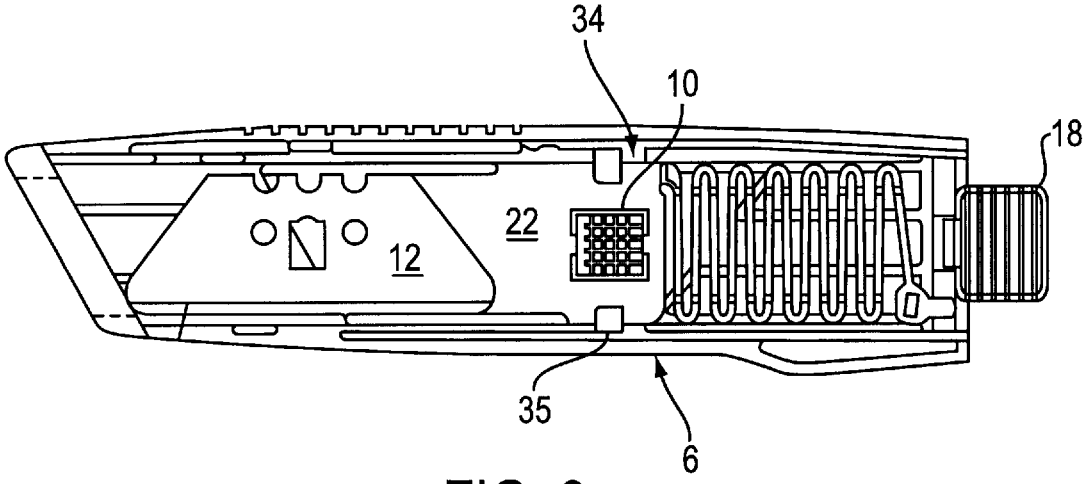
FIG. 9 is a top view of an automatically-retractable utility knife with the blade in the retracted position and with the upper housing removed.
Figure 10:
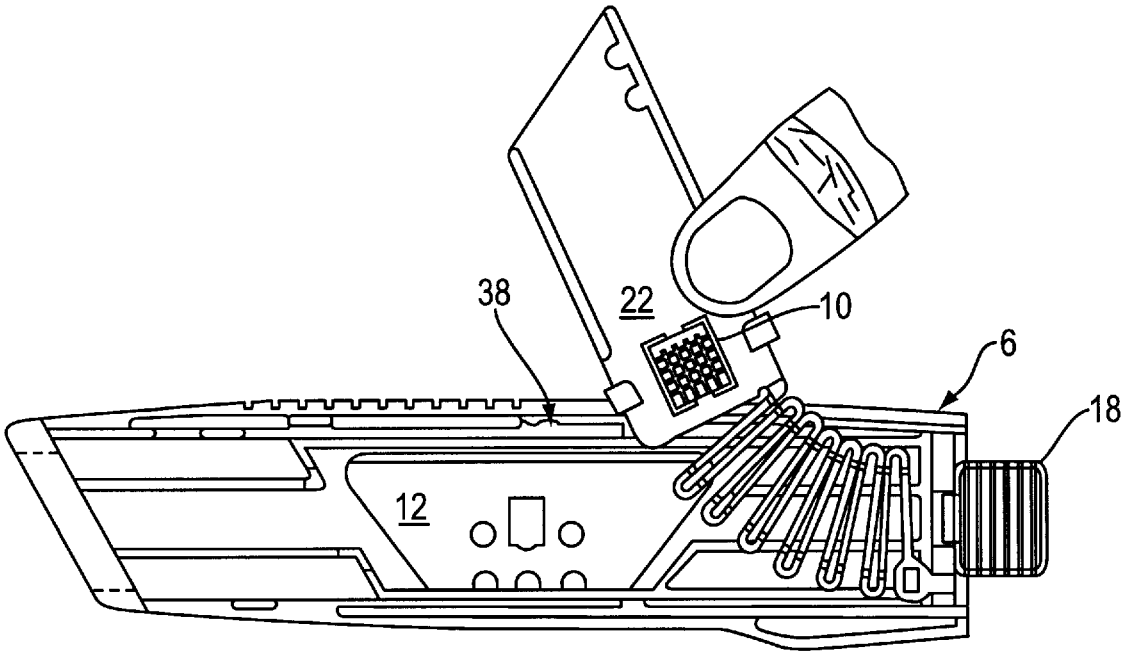
FIG. 10 is a top view of an automatically-retractable utility knife with the upper housing removed and with the blade carrier positioned to expose the spare blade holding area.
Figure 11:
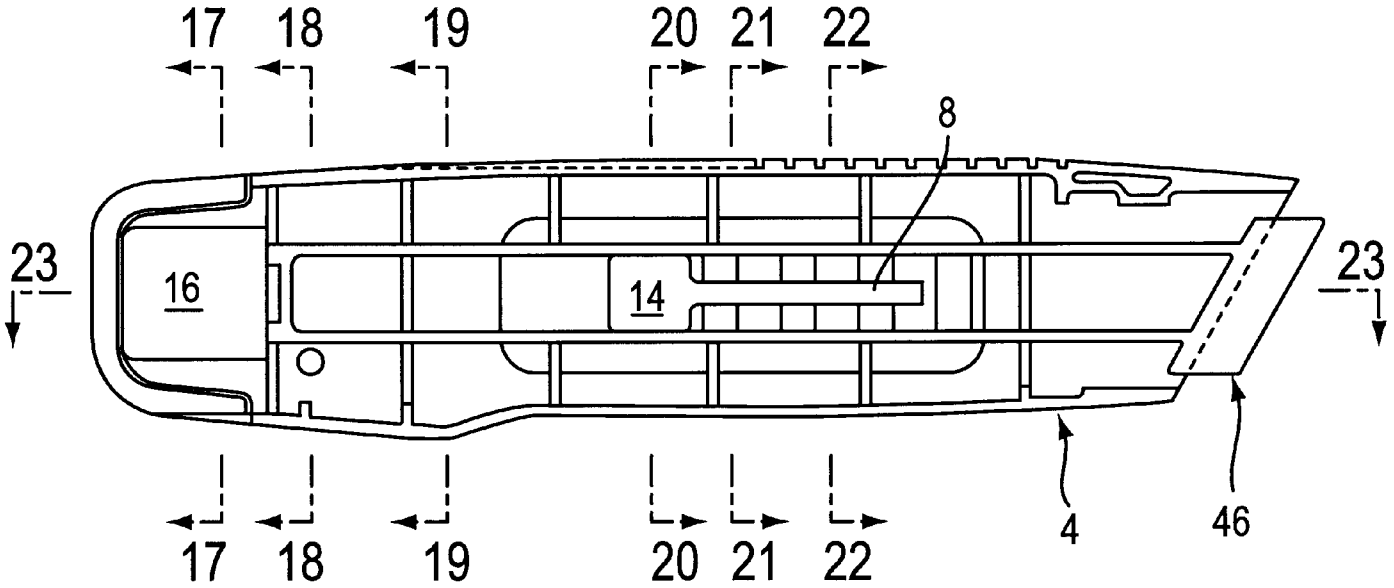
FIG. 11 is a bottom view of the upper housing of the utility knife.
Figure 12:
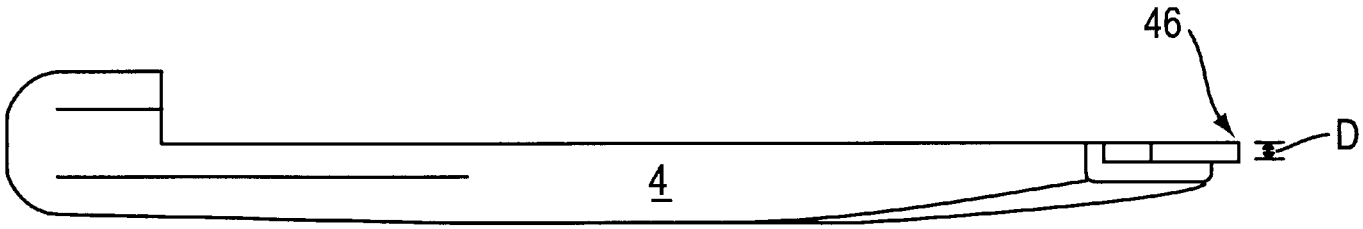
FIG. 12 is a side view of the upper housing shown in FIG. 11.
Figure 15:
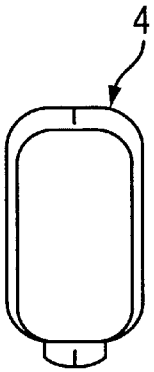
FIG. 15 is an end view of the upper housing shown in FIG. 11.
Figure 13:
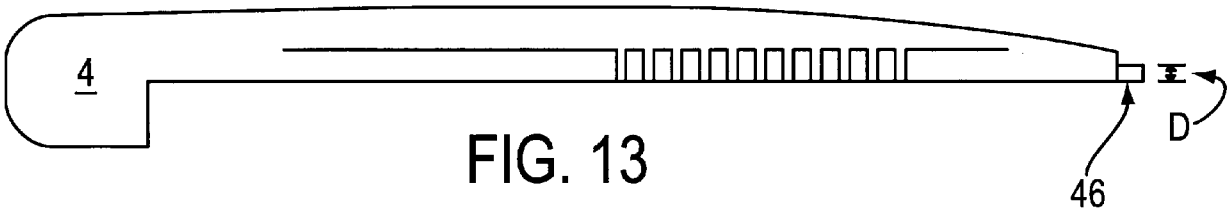
FIG. 13 is an opposite side view of the upper housing shown in FIG. 11.
Figure 14:
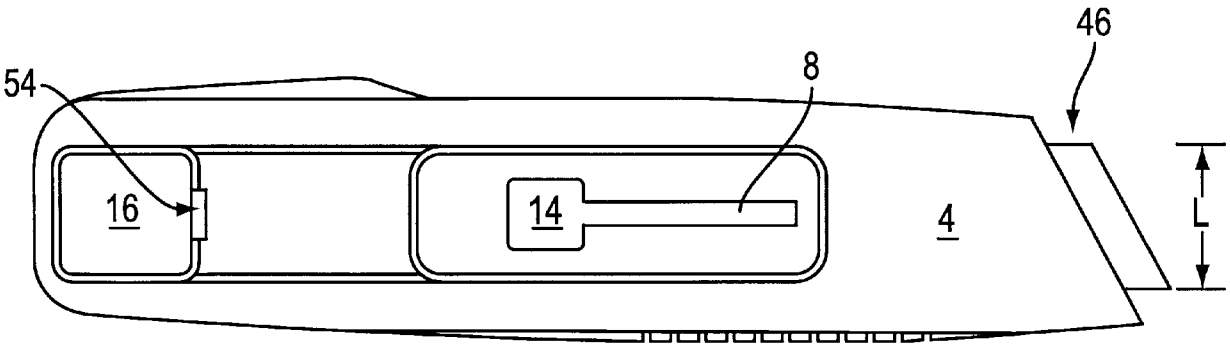
FIG. 14 is a top view of the upper housing shown in FIG. 11.
Figure 16:
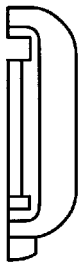
FIG. 16 is an opposite end view of the upper housing shown in FIG. 11.
Figure 17:
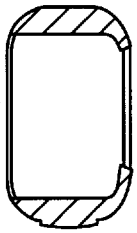
FIGS. 17–23 are cross-sectional views of the upper housing shown in FIG. 11 through the Sections corresponding to each FIG. No.
Figure 18:
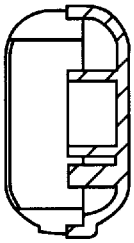
Figure 19:
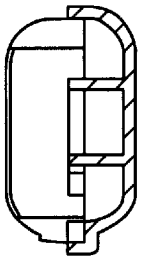
Figure 20:
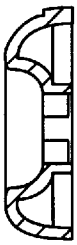
Figure 21:
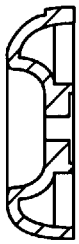
Figure 22:
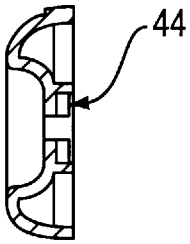
Figure 24:
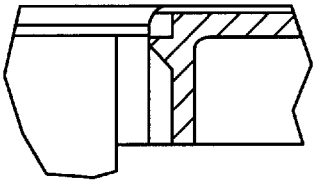
FIG. 24 is an exploded view of the circumscribed area "A" in FIG. 23.
Figure 53:
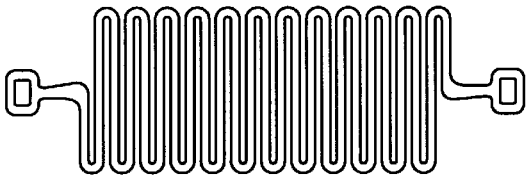
FIGS. 53 and 54 are front and side views respectively of a serpentine-shaped plastic spring in accordance with the invention.
Figure 54:
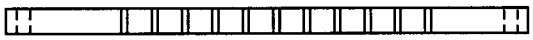

As shown in FIGS. 8–10 and 43–49, an automatically retractable blade carrier 22 may be used with the same housing described above with respect to indexed blade carrier 24. Carrier end stops 35 engage with detents 34 to prevent rearward movement of the blade carrier beyond a full rear position. A thumb piece 10 enables the carrier to be moved within the housing for exposing and retracting the blade. A retraction spring 60, which is preferably a serpentine-shaped flat spring, is integrally molded with a base portion 62 of carrier 22. A pin 64 on lower housing 6 extends through an aperture 66 at the free end of retraction spring 60. FIG. 8 shows the automatically retractable utility knife with the carrier in the forward position, i.e., with the blade in the fully extended position. In this position, retraction spring 60 is under tension and provides a retraction force on the carrier toward the rear of the housing. Force on the thumb piece 10 causes carrier 22 to move toward the distal end of the housing, thereby placing spring 60 under additional tension and exposing blade 12. Carrier 22 is guided by slot 8, support shoulders 37, and carrier guides 20 during movement within the housing. Once the thumb piece 10 is released, retraction spring 60 automatically pulls carrier 22 toward the rear of the housing, thereby retracting blade 68 to within the housing. As shown in FIG. 10, the automatically-retractable carrier 22 may be bent outward from the housing with retraction spring 60 still mounted to pin 64 to enable spare blades to be removed from a spare blade storage area within the lower housing. If desired, as shown in FIGS. 53 and 54, spring 60 need not be integrally molded with the carrier, but may be a separate unit that is inserted between the lower housing and the carrier. In such and embodiment, a pin on the lower housing would extend through an aperture at one end of the retraction spring, and a similar pin on the carrier would extend through an aperture on the other free end of the retraction spring. Other securing mechanisms may be employed, if desired.

The automatically retractable blade carrier with the integral spring is manufactured by injection molding so that it is extremely economical as compared to conventional utility knives in which a separate metallic spring is used. The mold for the carrier is machined with as many zigzags as are desired for the spring and with as many cavities as the desired number of parts to be produced in each cycle of the molding process. The acetal resin or other resilient plastic is then heated and injected in a hot liquid state into the mold as in a conventional molding process. The mold is then cooled and the completed carriers are ejected. If, for example, there are 20 cavities in a mold, and the cycle takes 15 seconds, 80 carriers per minute, with integral springs, may be produced. Because the parts are constructed of resilient plastic, they are finished, non-conductive, non-corrosive, self-lubricated and ready for assembly, immediately upon being ejected from the mold, as compared to metallic springs which must be wound, cut, looped, plated, and possibly lubricated before use.

Beside the cost factor, another advantage of using a plastic carrier is that the unused portion of the blade, i.e., the portion of the blade that remains within the housing, rests against a plastic ledge that will not dull the unused blade edge before reversing, as may occur if the blade is resting on a hardened metal carrier. Also, the acetal resin has a very low coefficient of friction so that no lubricant is needed to make the carrier slide well. Most metal carriers need grease to slide properly. However, when dirt enters the housing, it mixes with the lubricant and restricts the movement of the carrier.

The upper and lower housings are preferably constructed of any appropriate plastic material, such as ABS or high impact styrene. The blade carriers are preferably constructed of any appropriate plastic material, and more preferably are constructed of an acetal resin, such as Celcon™ or Delrin™. These materials are sufficiently resilient to provide spring force in central arm 40, in release lever 18, and in spring 60 on automatically retracting blade carrier 22. It is foreseen that the invention may be made of other types of plastics and/or any other appropriate material that is capable of performing the functions described herein. It is also foreseen that the invention may be modified to be usable with box-cutter type knives or other knives that utilize conventional rectangular razor blades.

Figure 50:
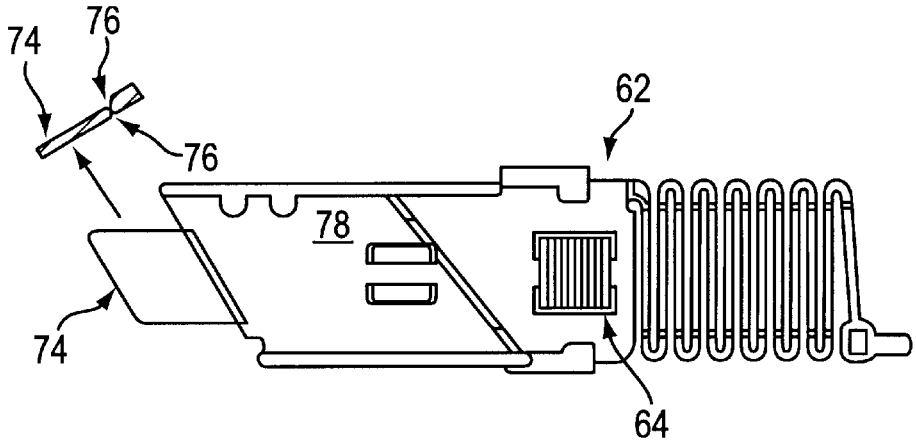
FIG. 50 is a top view of a blade carrier with separate thumb buttons for right handed and left handed persons, and a snap off portion for obtaining greater blade extension.
Figure 51:
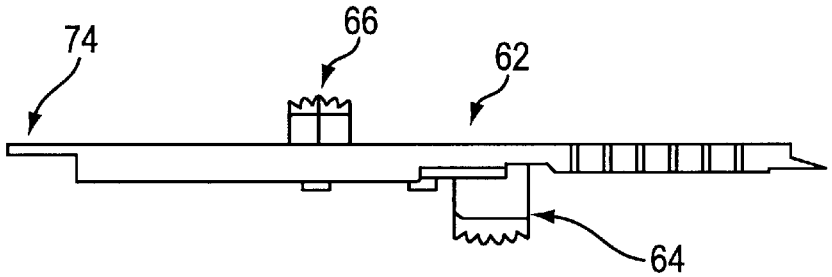
FIG. 51 is a side view of the blade carrier shown in FIG. 50.
Figure 52:
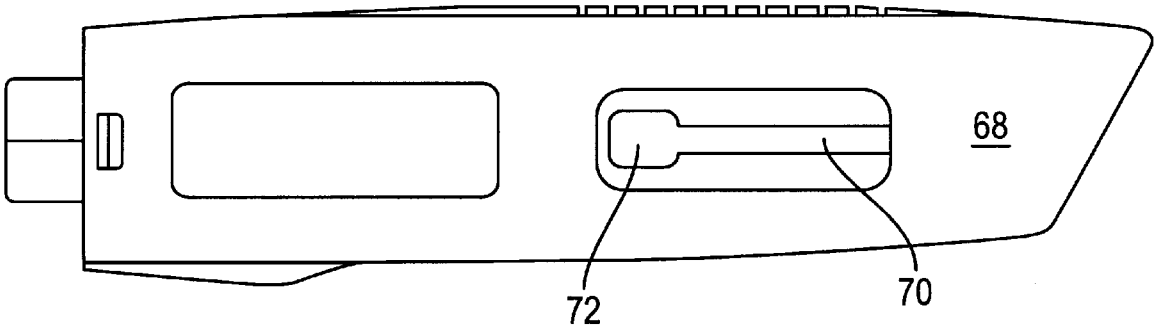
FIG. 52 is a top view of an alternative bottom housing cover for use with the blade carrier shown in FIG. 50.

In an alternative embodiment shown in FIGS. 50–52, automatically retracting blade carrier 62, which is similar to carrier 22 previously described, includes a first thumb piece 64 on the front side thereof, and a second thumb piece 66 on the rear side thereof. The upper housing, which is similar or identical to previously described upper housing 4, includes a slot 8 through which thumb piece 64 extends and is guided. As shown in FIG. 52, lower housing 68 includes a slot 70 having an enlarged opening 72 through which thumb piece 66 extends and is guided. Accordingly, the utility knife of the invention includes separate thumb buttons for left and right handed persons and may be used by such persons without modification or the need to remove and reverse the blade.

Automatically retracting blade carrier 62 also includes an extension 74, as shown in FIGS. 50 and 51. Extension 74 is preferably integrally molded with the carrier, which may be either an indexed carrier or an automatically retractable carrier. A pair of V cross-section scores 76 are preferably molded at the intersection of extension 74 and the forward portion 78 of the carrier body. These scores enable the extension to be permanently snapped off from the body of the carrier when desired. With the extension in place. Extension 74 is sized so that when the carrier is moved to the extended position, extension 74 will contact the peripheral walls that define distal end slot 32 and prevent further forward movement of the blade carrier. The extension 74 is sized lengthwise so that in the full forward position, in which the extension is in contact with the periphery of distal end slot 32, the blade extends slightly, e.g., 0.25 inches, from the housing. When extension 74 is snapped off from the base of the carrier, the blade may be fully extended from the housing as in the prior embodiment.

It will be appreciated that the plastic spring of the invention may replace metal springs in most momentary applications, i.e., those applications in which the spring is only momentarily compressed, or any application in which the spring is not compressed long enough to set. Examples of such applications are keyboard keys, door stops, momentary switches, cabinet door locks, doorbell button, etc. The advantages of the use of such springs is that they are nonelectrically conductive, can be molded in the finished color, can be molded integrally with another part, are extremely economical, and do not require external lubrication.

Figure 55:
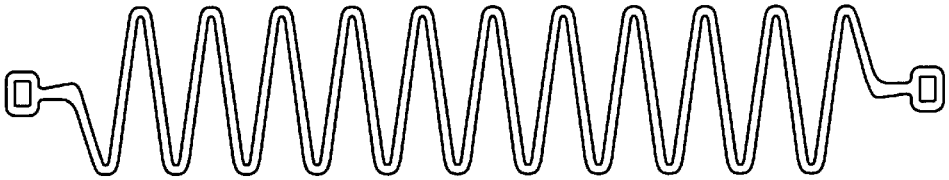
FIGS. 55 and 56 are front and side views respectively of a serpentine-shaped plastic spring which is molded in an extended position.
Figure 56:
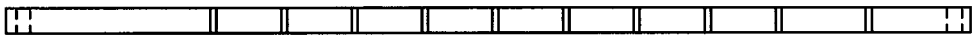

An alternative spring design is shown in FIGS. 55 and 56. In this embodiment, the spring is accordion shaped and molded in a relaxed position in which the spring is somewhat elongated. This spring acts as either a compression spring, in which the spring applies a return force to its at rest position when compressed, or an extension spring, in which the spring applies a return force to its at rest position when extended.

Figure 57:
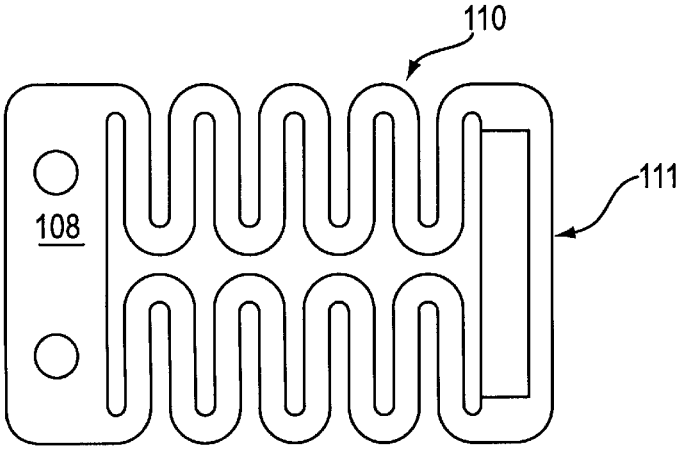
FIGS. 57 and 58 are top and end views respectively of an integrally-molded door or cabinet stop in accordance with the invention.
Figure 58:
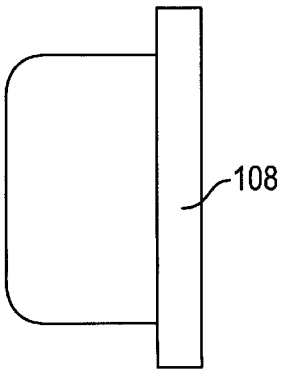

As shown in FIGS. 57 and 58, one application of this type of spring is as a cushioning door or cabinet stop. A flange 108 is preferably integrally molded with spring 110 on one end of the spring, and a door contact 111 is preferably integrally molded with the other end of the spring. Flange 108 is attached to the wall or floor behind a door with screw or the like. When the door is opened and contacts door contact 110, the spring is compressed and prevents the door from striking the wall.

In an alternative application (not shown), a spring of the type shown in FIG. 55 may be molded integrally with a hospital bracelet so as to enable universal size adjustment and to improve the comfort of such bracelets. In this application, if the bracelet is left on the wrist in an extended position for too long a period of time, e.g., several weeks, the spring may begin to set in the extended position and the bracelet may require replacement.

Figure 59:
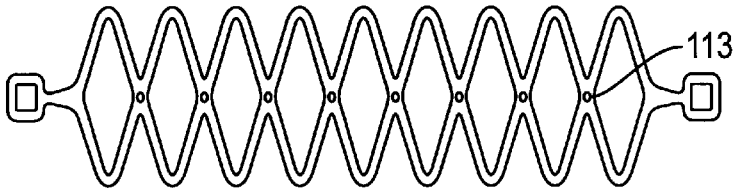
FIG. 59 is a front view of a molded plastic spring with an x-shape cross-section.
Figure 60:
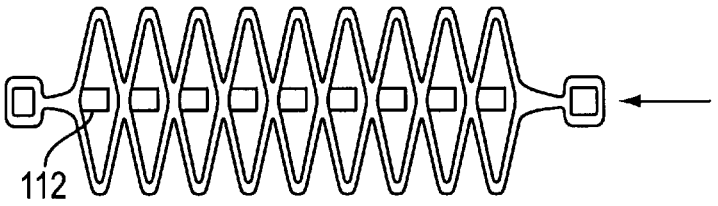
FIG. 60 is a front view of a spring similar to that shown in FIG. 59 in a compressed position.
Figure 61:
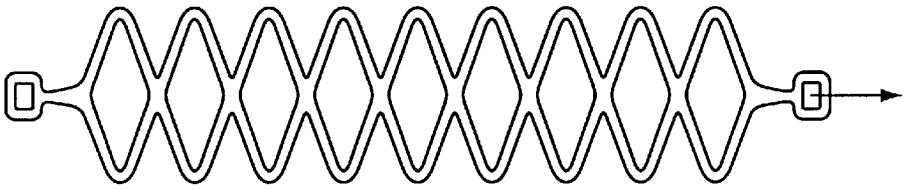
FIG. 61 is a front view of a spring similar to that shown in FIG. 59 in an extended position.

FIGS. 59–61 show a plastic spring having an X-shaped configuration. In FIG. 59, the spring is shown in a relaxed position in which it is molded. FIG. 60 shows the spring in a compressed position. If desired, spring stops 112 may be molded integrally with the spring to limit the compression distance so as to prevent overtravel. Also, guide pins 113 that extend upwardly from the spring may be molded integrally therewith. The guide pins may be mounted in a track (no shown) to facilitate guiding of the spring to prevent lateral or other undesired movement of the spring. FIG. 61 shows the spring in an extended position.

Figure 62:
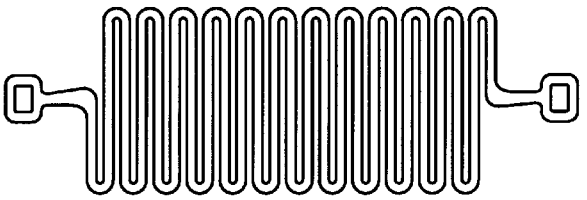
FIGS. 62 and 63 are front and side views respectively of a molded plastic spring with a tapered thickness.
Figure 63:
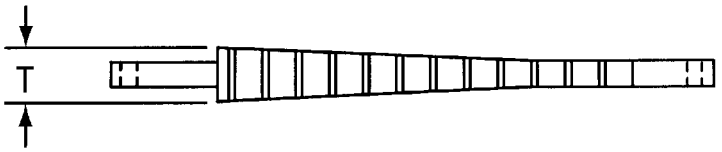
Figure 64:
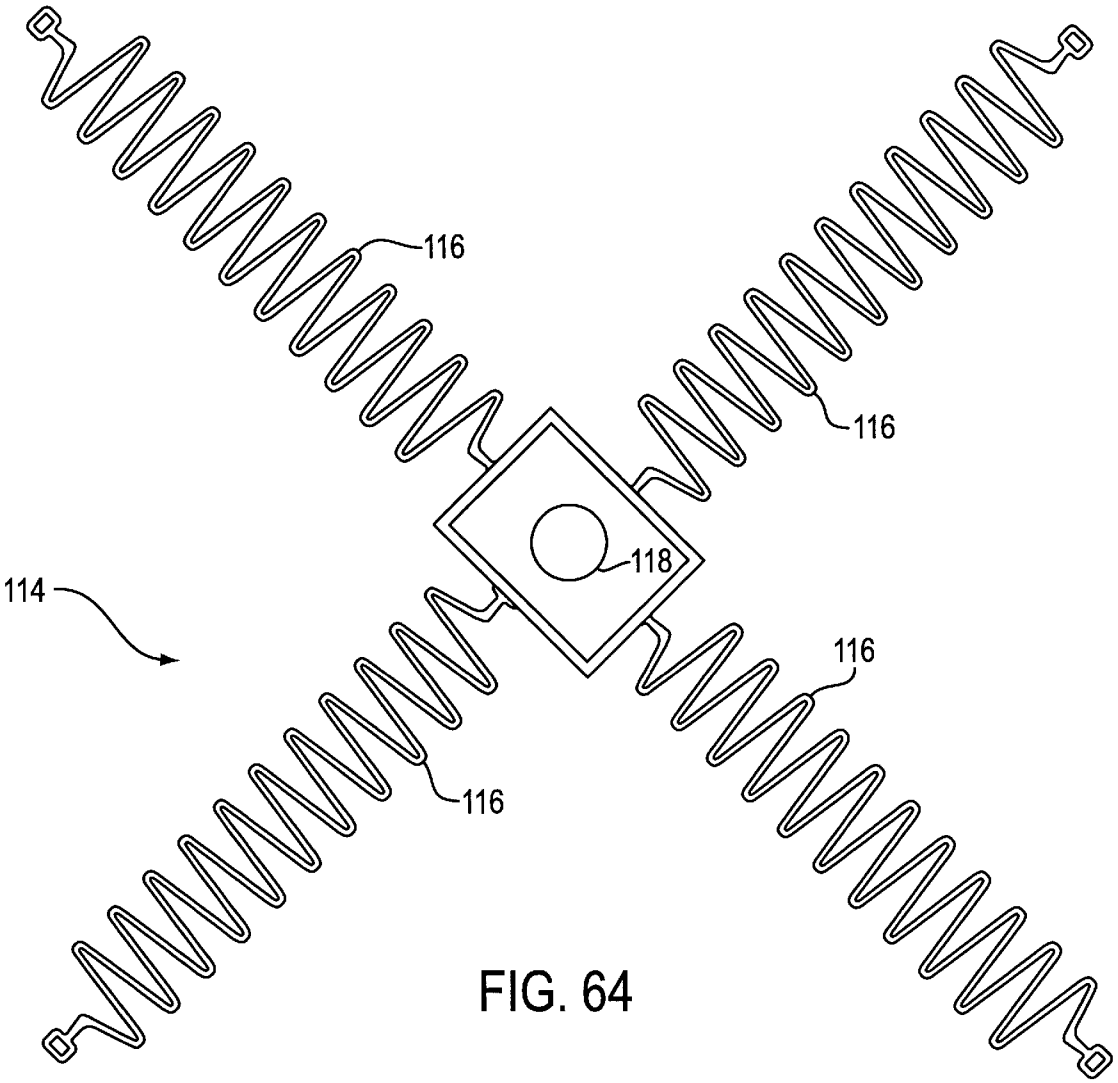
FIGS. 64 and 65 are front views of plastic springs molded to permit clearance for another part.
Figure 65:
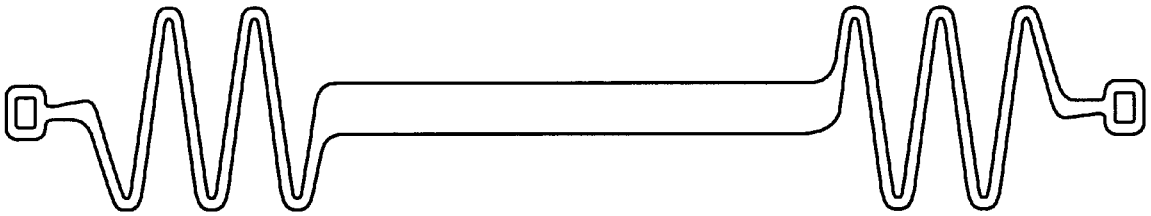
Figure 66:
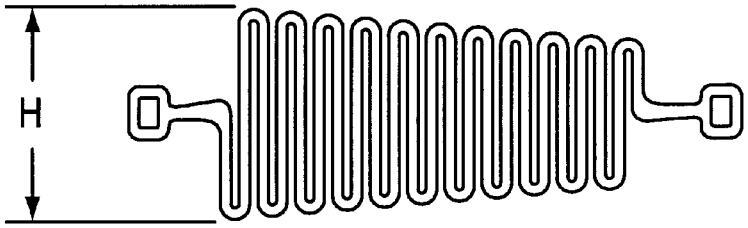
FIGS. 66 and 67 are front and side views respectively of a plastic spring with a tapered height.
Figure 67:
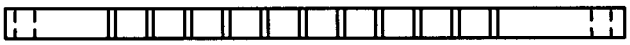

As shown in FIGS. 62 and 63, the thickness "T" of the spring may be varied, if desired, in order to use the spring in applications in which there is insufficient clearance for a spring with a fixed thickness. Moreover, as shown in FIG. 64, the spring may be molded in odd-shaped configurations in order to provide clearance for other parts. For example, spring 114 may include four spring elements 116 with a central opening sufficient to enable clearance of a part, e.g., a pipe 118 or shaft therethrough. FIG. 65 shows an alternative example of a spring molded in an odd shape to permit adequate clearance of another part. In FIGS. 66 and 67, the spring height "H" is varied to facilitate its use in an application with limited clearance.

Figure 68:
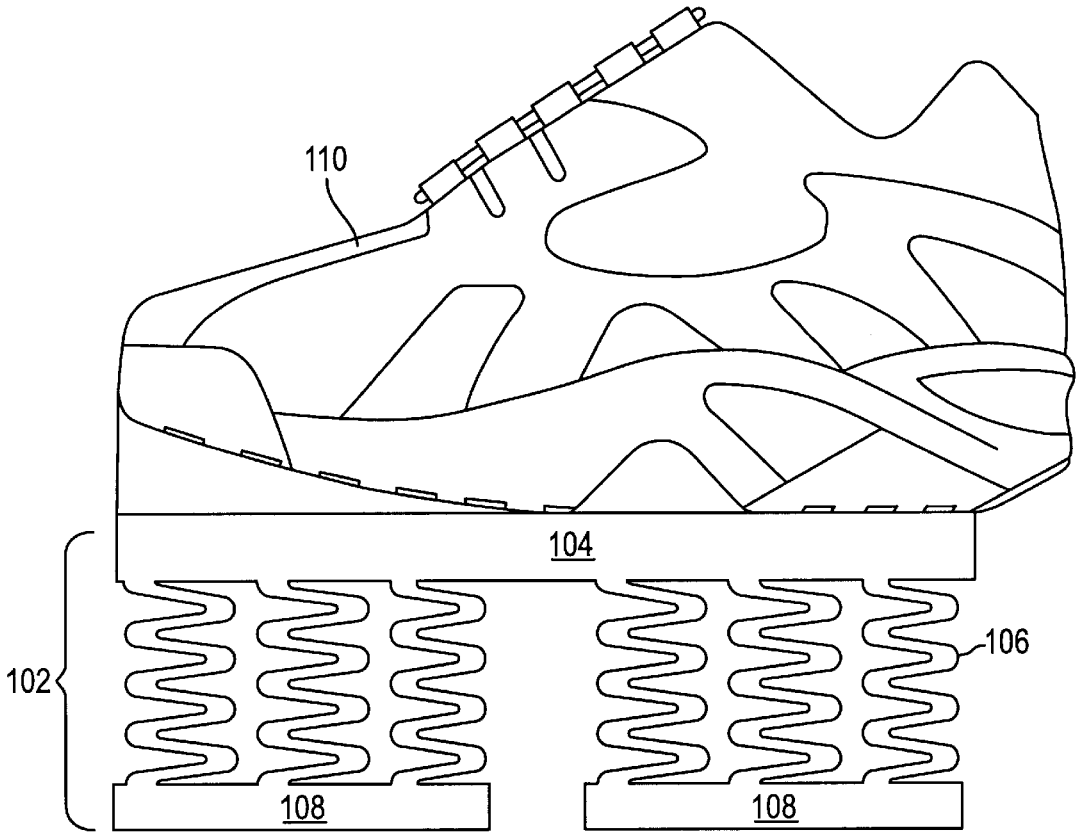
FIG. 68 is a side view of a jumping shoe in accordance with the invention.

FIGS. 68–80 show various further applications of the molded or extruded plastic spring in accordance with the present invention. In FIG. 68, a shoe 100 is mounted to a spring portion 102 by any appropriate means. Spring portion 102, which is preferably of all-plastic construction, includes an upper plate 104 integrally molded with spring members 106 which are integrally constructed with lower plate 108. Springs 106 are serpentine-shaped and enable the person wearing the shoe to jump up and down for a unique novelty effect. Spring portion 102 is preferably as wide as shoe 100 and may be molded or extruded. It will be appreciated that the shoe 100 will ordinarily not be worn for a sufficient amount of time for springs 106 to set in a compressed condition.

Figure 69:
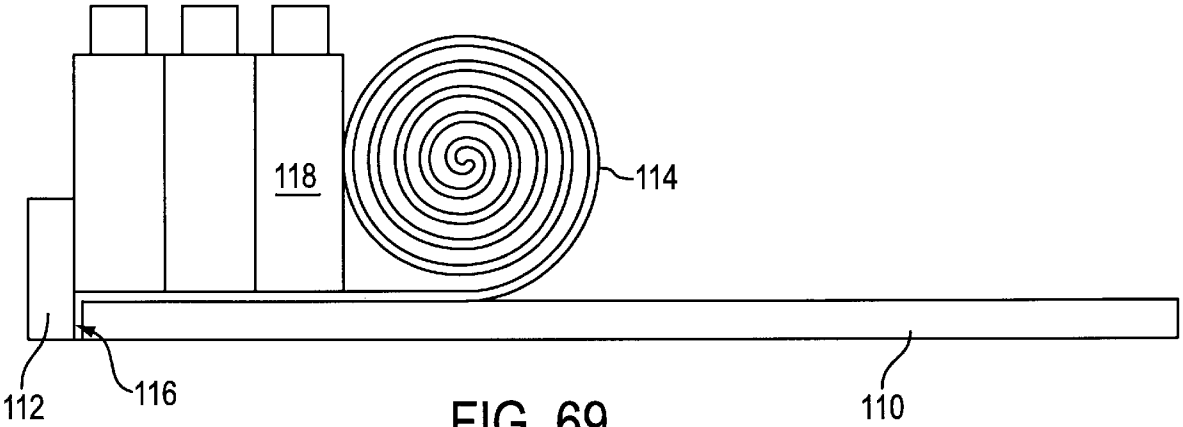
FIGS. 69 and 70 are side views of an apparatus for pushing articles on a shelf to the front of the shelf using a molded plastic spring.
Figure 70:
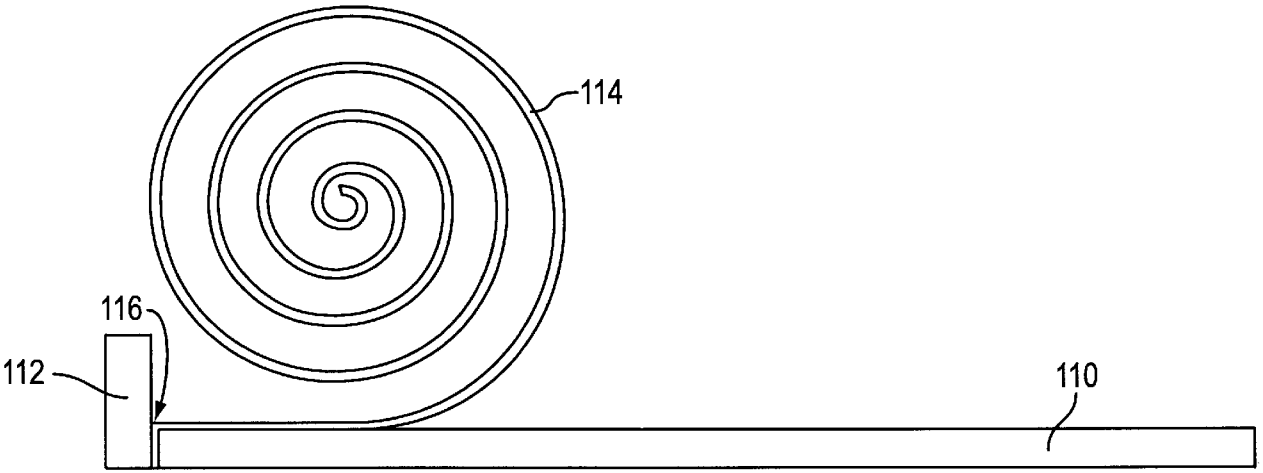

FIGS. 69 and 70 show a plastic coil spring which may be used to push articles on a store shelf 110 toward a forward end 112 of the shelf. Spring 114 is preferably extruded, and includes a downward facing lip 116 which is inserted into a corresponding indent in shelf 110 in order to secure spring 114. As articles 118 are placed on the shelf, spring 114 becomes more tightly coiled thereby increasing the forward force on articles 118. It will be appreciated that spring 114 in this embodiment may be utilized only with products that are sold frequently in order to avoid spring 114 becoming set in a more tightly coiled position, which would prevent the spring from pushing articles 118 forward. FIG. 70 shows spring 114 in a relaxed position with no articles on shelf 110. Because spring 114 may be extruded, it may be constructed as wide as desired, and cut to length.

Figure 72:
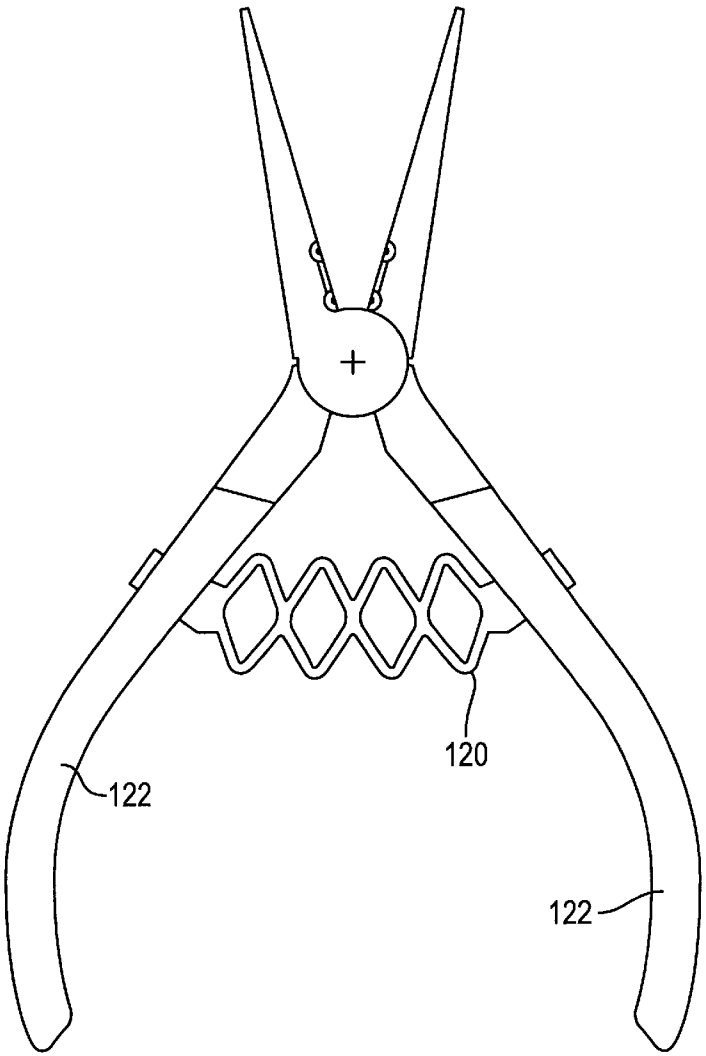
FIGS. 71 and 72 are side views of a pair of pliers with a molded spring device for restoring the handles to an open position.
Figure 71:
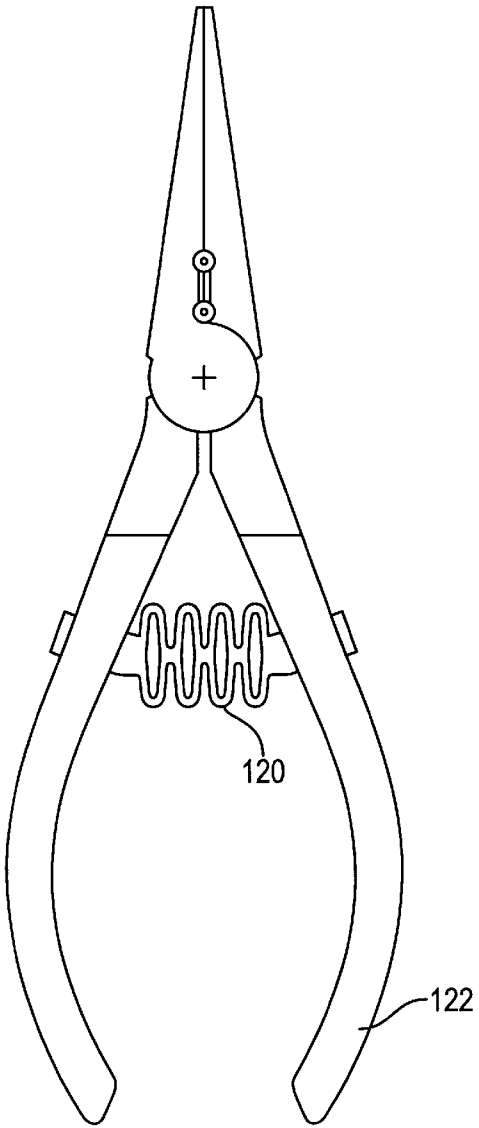

FIGS. 71 and 72 show a one-piece molded snap-on spring opener for a plier or the like. FIG. 72 shows spring opener 120 in its molded state. Spring opener 120 includes snap-on fittings on its ends for attachment to plier handles 122 and provides an outward force on the handles to retain the pliers in the open state. When the plier handles are compressed, as shown in FIG. 71, the outward force on handles 122 increases in order to restore the handles to an open state once pressure on the handles is released. Similarly, a spring closer may be molded in a shape like that shown in FIG. 71 which would provide a return force on handles 122 to pull the handles to a closed position when outward pressure on the handles is released.

Figure 73:
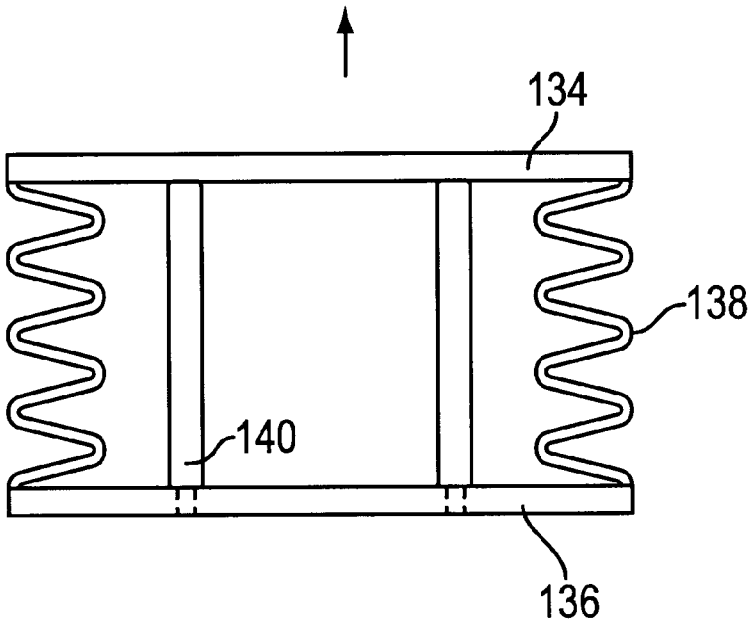
FIG. 73 is a side view of an extension spring unit.

FIG. 73 shows an extension spring unit which includes upper and lower platforms 134 and 136. Springs 138 are integrally molded with platforms 134 and 136 in the position shown. Return stops 140, which are attached to lower platform 136 but not to upper platform 134 limit the return travel of upper platform 134 when returned to its starting position by the spring force of springs 138. As upper platform 134 is raised, springs 138 provide the return force to return upper platform 134 to its original position.

Figure 74:
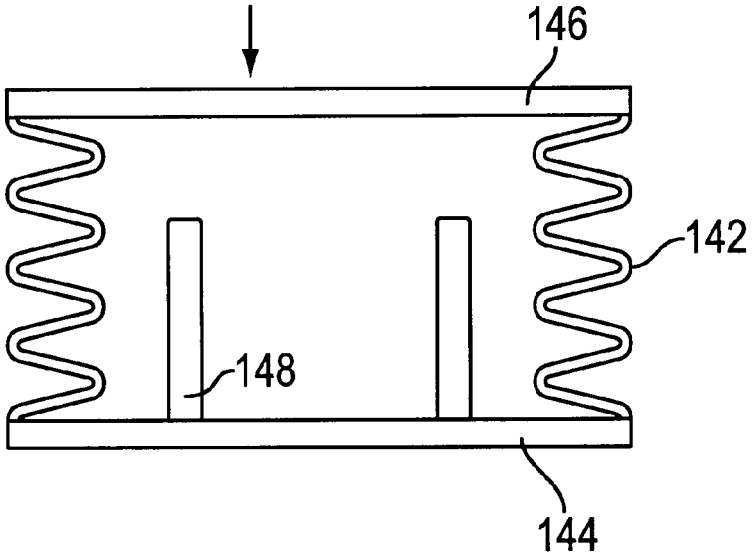
FIG. 74 is a side view of a compression spring unit.

Similarly, FIG. 74 shows a compression spring unit in which springs 142 are molded in the position shown integral with lower platform 144 and upper platform 146. A pair of return stops 148 are molded integral with lower platform 144. When upper platform 146 is depressed, springs 142 provide a return force to return it to its starting position. A compression spring unit of this type may be used, for example, in keyboard keys, momentary switches, or the like.

Figure 75:
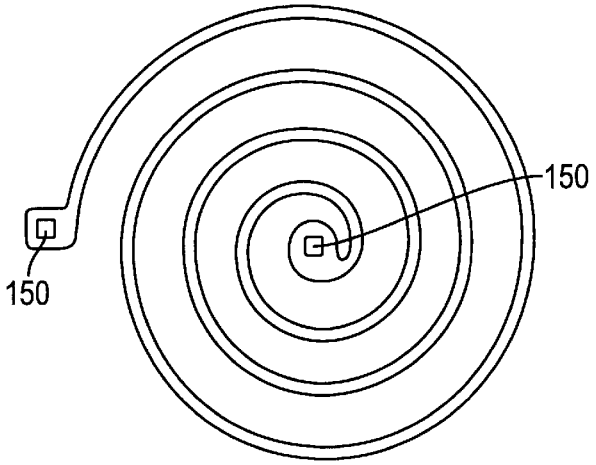
FIG. 75 is a front view of an integrally molded spiral coil spring.
Figure 76:
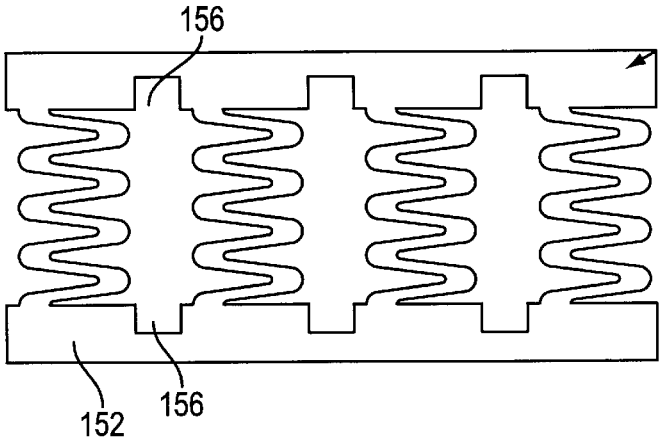
FIGS. 76 and 77 are side views of molded stacks of springs used to form a grid pattern.
Figure 77:
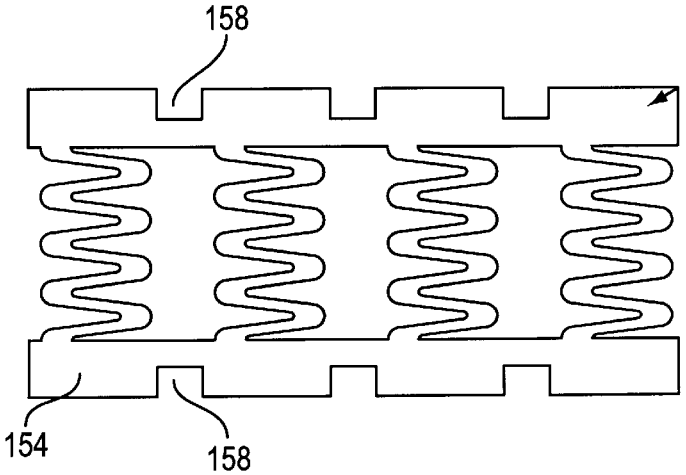

FIG. 75 shows a spiral coil spring of all-plastic construction. This spring is similar to that used in connection with the example shown in FIGS. 69 and 70. This type of coil spring may be used in any momentary application in which a coil spring is used, e.g., a door knob. Mounting holes 150 are molded in the ends of the spring to facilitate the securing of the spring in the desired application.

Figure 78:
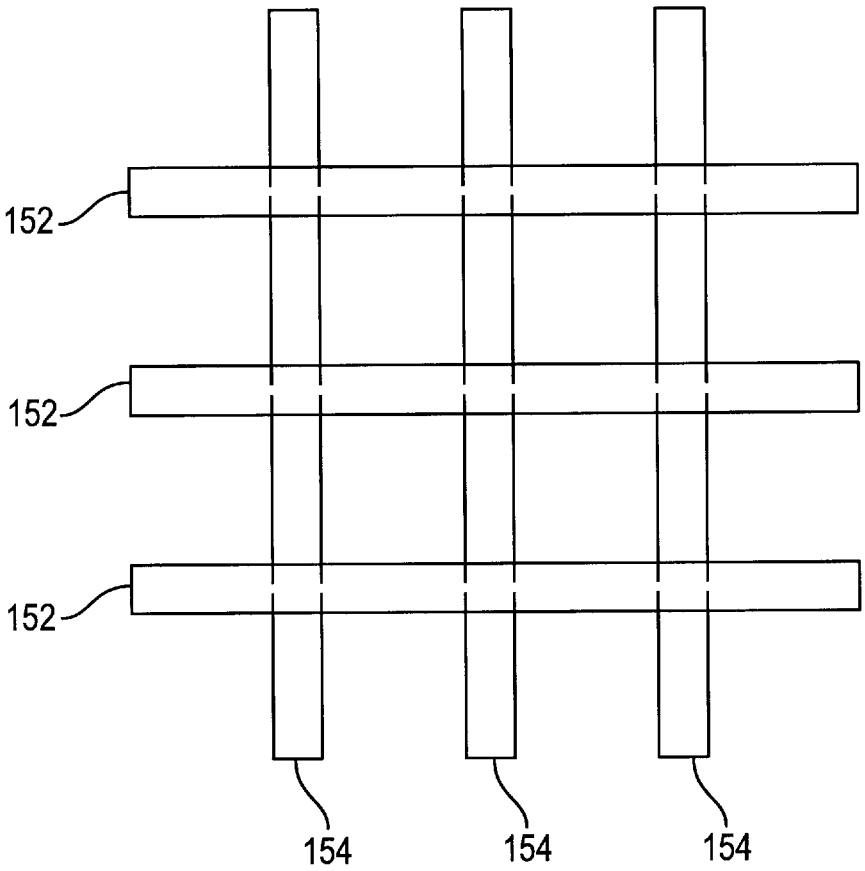
FIG. 78 is a top view of a spring grid pattern formed using the springs shown in FIGS. 76 and 77.
Figure 79:
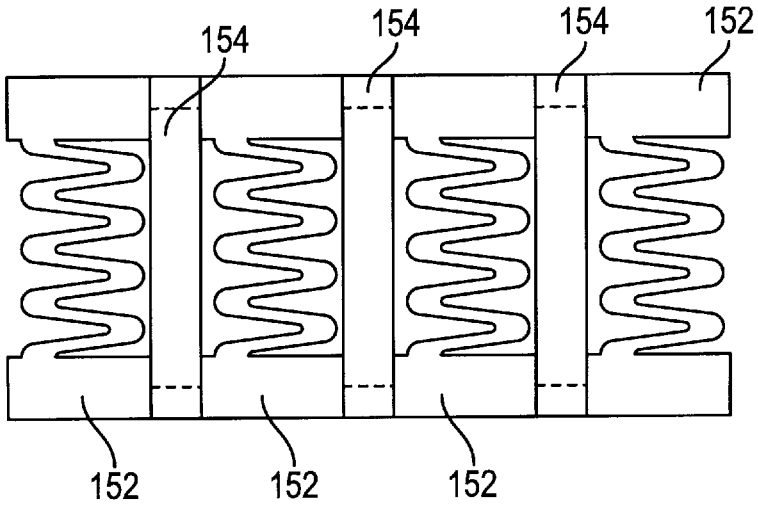
FIG. 79 is a side view of the spring assembly shown in FIG. 78.

FIGS. 76–79 show a criss-cross spring assembly that is constructed of first spring units 152 and second spring units 154 that interlock as shown in FIG. 78. Each of the spring units is integrally molded or extruded and includes corresponding cutouts 156 and 158 that enable the units to be interlocked. Because the springs may be formed into an assembly, they may be used for applications in which a larger surface area of spring is required, e.g., seat cushions, mattresses, etc.

Figure 80:
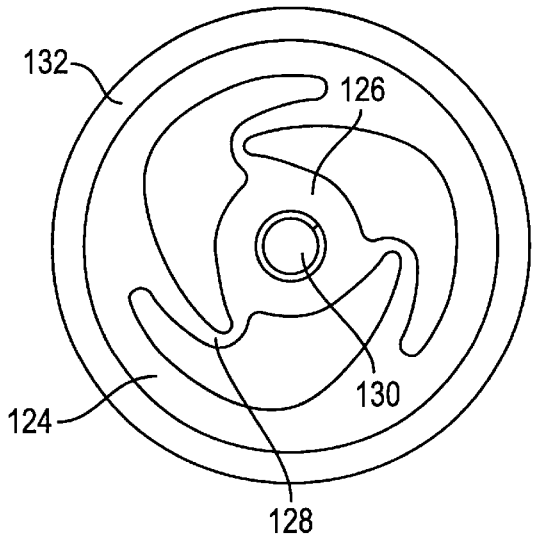
FIG. 80 is a side view of an integrally molded plastic shock-absorbing wheel.

Finally, FIG. 80 shows an embodiment of the invention in which a wheel, for a skateboard, conveyer, or the like. An outer hub 124 is integrally molded with an inner hub 126 and spring members 128. A hole 130 is molded in inner hub 126 for enabling the wheel to be mounted to a shaft or the like. The wheel is preferably constructed of an acetal resin which has a low coefficient of friction and may thereby eliminate the need for bearings in the hub. An outer cushioning material 132, which may be, for example, urethane, is separately applied to the outer circumferential portion of outer hub 124 for further cushioning. In use, the wheel has self-shockabsorbing properties as springs 128 flex and return in response to pressure on the wheel. In general, such a wheel would not be in a fixed compressed position for a sufficient amount of time to set in any but its originally molded position.

It will be appreciated that the plastic spring of the present invention may be utilized for any application in which metallic springs are used, provided that the application is a momentary application, or one in which the spring will not be compressed for a sufficient amount of time to be set in the compressed position. This amount of time will vary depending upon the size of the spring and the extent of compression.

Although the present invention has been described in detail with respect to certain embodiments and examples, variations and modifications exist which are within the scope of the present invention as defined in the following claims.

I claim:

1. An automatically retractable cutting device which comprises:

a housing;

a return spring disposed within the housing; and a blade carrier disposed within the housing, the blade carrier being biased by the return spring and comprising a snap-off extension for limiting forward travel of the blade carrier with the snap-off extension in place.

2. The automatically retractable cutting device according to a claim 1 wherein the return spring is constructed of a molded plastic.

3. The automatically retractable cutting device according to claim 2 wherein the return spring is serpentine shaped.

4. The automatically retractable cutting device according to claim 2 wherein the return spring is integrally molded with the blade carrier.

5. The automatically retractable cutting device according to claim 1 wherein the housing comprises a guide slot and the blade carrier comprises a thumb piece extending through the slot for facilitating movement of the blade carrier in the housing to extend and retract a razor blade.

6. The automatically retractable cutting device according to claim 1 wherein the housing comprises a front guide slot and a rear guide slot and the blade carrier comprises a thumb piece extending through the front guide slot and a thumb piece extending through the rear guide slot, each thumb piece facilitating movement of the blade carrier in the housing to extend and retract a blade.

7. The automatically retractable cutting device according to claim 1 further comprising a spring securing pin fixed to the housing for securing a free end of the return spring.

8. An automatically retractable cutting device which comprises:

a housing comprising a front guide slot and a rear guide slot;

a return spring disposed within the housing; and a blade carrier disposed within the housing, the blade carrier being biased by the return spring, the blade carrier comprising a thumb piece extending through the front guide slot and a thumb piece extending through the rear guide slot, each thumb piece facilitating movement of the blade carrier in the housing to extend and retract a blade.

9. The automatically retractable cutting device according to a claim 8 wherein the return spring is constructed of a molded plastic.

10. The automatically retractable cutting device according to claim 9 wherein the return spring is serpentine shaped.

11. The automatically retractable cutting device according to claim 2 wherein the return spring is integrally molded with the blade carrier.

12. The automatically retractable cutting device according to claim 8 further comprising a spring securing pin fixed to the housing for securing a free end of the return spring.

13. The automatically retractable cutting device according to claim 8 wherein the blade carrier comprises a snap-off extension for limiting forward travel of the blade carrier with the snap-off extension in place.

14. A cutting device which comprises:

a housing; and a blade carrier disposed within the housing, the blade carrier comprising a snap-off extension for limiting forward travel of the blade carrier with the snap-off extension in place.

15. A cutting device which comprises:

a housing comprising a front guide slot and a rear guide slot; and a blade carrier disposed within the housing comprising a thumb piece extending through the front guide slot and a thumb piece extending through the rear guide slot, each thumb piece facilitating movement of the blade carrier in the housing to extend and retract a razor blade.

* * * * *